US006802566B2

(12) United States Patent
Prince et al.

(10) Patent No.: US 6,802,566 B2
(45) Date of Patent: Oct. 12, 2004

(54) ARM ASSEMBLY FOR A CHAIR

(75) Inventors: Jonathan William Prince, Wellington (NZ); Paul Michael Wilkinson, Wellington (NZ)

(73) Assignee: Formway Furniture Limited, Wellington (NZ)

( * ) Notice: Subject to any disclaimer, the term of this patent is extended or adjusted under 35 U.S.C. 154(b) by 7 days.

(21) Appl. No.: 09/953,850

(22) Filed: Sep. 17, 2001

(65) Prior Publication Data

US 2002/0036422 A1 Mar. 28, 2002

Related U.S. Application Data

(60) Provisional application No. 60/236,925, filed on Sep. 28, 2000.

(51) Int. Cl.[7] ..... A47C 7/54

(52) U.S. Cl. ..... 297/411.37; 297/411.36; 297/411.27

(58) Field of Search ..... 297/411.35, 411.36, 297/411.37, 411.2, 411.23, 411.29, 411.27, 411.24; 248/118, 118.3

(56) References Cited

U.S. PATENT DOCUMENTS

| | | | |
|---|---|---|---|
| 226,082 | A | 3/1880 | Lemman |
| 272,579 | A | 2/1883 | Paulding |
| 323,060 | A | 7/1885 | Moore |
| 614,235 | A | 11/1898 | Palmer |
| 662,247 | A | 11/1900 | Vinton |
| 662,647 | A | 11/1900 | Howe |
| 1,120,686 | A | 12/1914 | Burrowes |
| 1,976,793 | A | 10/1934 | Mangold |
| 2,071,974 | A | 2/1937 | Gunlocke |
| 2,471,024 | A | 5/1949 | Cramer |
| 2,590,995 | A | 4/1952 | Merrill |
| 2,612,211 | A | 9/1952 | Gielow et al. |
| 2,796,918 | A | 6/1957 | Luckhardt |
| 2,804,129 | A | 8/1957 | Propst |
| 2,833,339 | A | 5/1958 | Liljengren |
| 2,845,997 | A | 8/1958 | Waite |
| 2,858,572 | A | 11/1958 | Burdick |
| 2,887,692 | A | 5/1959 | Gosman |
| 2,962,764 | A | 12/1960 | Trojanowski et al. |
| 3,009,578 | A | 11/1961 | Foote et al. |
| 3,015,148 | A | 1/1962 | Haddad |
| 3,030,640 | A | 4/1962 | Gosman |
| 3,041,109 | A | 6/1962 | Eames et al. |
| 3,107,991 | A | 10/1963 | Taussig |
| 3,112,987 | A | 12/1963 | Griffiths et al. |
| 3,115,678 | A | 12/1963 | Keen et al. |
| 3,124,092 | A | 3/1964 | Raynes |
| 3,165,359 | A | 1/1965 | Ashkouti |
| 3,208,085 | A | 9/1965 | Grimshaw |
| 3,214,314 | A | 10/1965 | Rowbottam |
| 3,222,698 | A | 12/1965 | Levenson |

(List continued on next page.)

FOREIGN PATENT DOCUMENTS

| | | |
|---|---|---|
| DE | 29 40 641 A1 | 4/1981 |
| DE | 30 17 163 A1 | 11/1981 |
| DE | 42 16 358 A1 | 11/1992 |

(List continued on next page.)

*Primary Examiner*—Peter M. Cuomo
*Assistant Examiner*—Stephanie Harris
(74) *Attorney, Agent, or Firm*—Workman Nydegger

(57) ABSTRACT

An arm assembly (24) is provided for a chair (12). The chair (12) has a forward direction and a rearward direction. The arm assembly (24) includes an armrest (26) and a support structure (28). A mounting device movably mounts the armrest to the support structure. The mounting device constrains the movement of the armrest (26) relative to the support structure to movement in a substantially horizontal plane having two degrees of freedom defined by first and second transversely arranged axes lying within the substantially horizontal plane. The armrest (26) thus move in a substantially planar fashion without changing the orientation of the armrest (26).

50 Claims, 23 Drawing Sheets

U.S. PATENT DOCUMENTS

| | | | |
|---|---|---|---|
| 3,273,877 | A | 9/1966 | Geller et al. |
| 3,298,743 | A | 1/1967 | Albinson et al. |
| 3,301,931 | A | 1/1967 | Morin |
| 3,314,721 | A | 4/1967 | Smith |
| 3,319,274 | A | 5/1967 | Upton |
| 3,399,883 | A | 9/1968 | McKey |
| 3,399,926 | A | 9/1968 | Hehn |
| 3,431,022 | A | 3/1969 | Poppe et al. |
| 3,434,181 | A | 3/1969 | Benzies |
| 3,534,129 | A | 10/1970 | Bartel |
| 3,546,724 | A | 12/1970 | Bastos et al. |
| 3,589,967 | A | 6/1971 | Shirakawa |
| 3,620,568 | A | 11/1971 | Morrow |
| 3,652,126 | A | 3/1972 | Folling |
| 3,712,666 | A | 1/1973 | Stoll |
| 3,740,792 | A | 6/1973 | Werner |
| 3,770,235 | A | 11/1973 | Klapproth et al. |
| 3,826,456 | A | 7/1974 | Tranter et al. |
| 3,937,518 | A | 2/1976 | Harrison |
| 3,942,835 | A | 3/1976 | Harrison |
| 3,950,026 | A | 4/1976 | Van Seenus |
| 3,974,532 | A | 8/1976 | Ecchuya |
| 4,017,118 | A | 4/1977 | Cawley |
| 4,040,661 | A | 8/1977 | Hogan et al. |
| 4,043,592 | A | 8/1977 | Fries |
| 4,054,317 | A | 10/1977 | Stumpf |
| 4,122,568 | A | 10/1978 | Bastos et al. |
| 4,123,104 | A | 10/1978 | Andres et al. |
| 4,143,910 | A | 3/1979 | Geffers et al. |
| 4,145,020 | A | 3/1979 | Webster |
| 4,154,478 | A | 5/1979 | Cohune |
| 4,158,899 | A | 6/1979 | Budimirov |
| 4,159,148 | A | 6/1979 | Schulz |
| 4,191,422 | A | 3/1980 | Inasawa et al. |
| 4,202,581 | A | 5/1980 | Fleishman |
| 4,205,878 | A | 6/1980 | Wooten |
| 4,265,482 | A | 5/1981 | Nishimura et al. |
| 4,285,545 | A | 8/1981 | Protze |
| 4,345,733 | A | 8/1982 | Ambasz et al. |
| 4,353,595 | A | 10/1982 | Kaneko et al. |
| 4,380,352 | A | 4/1983 | Diffrient |
| 4,390,204 | A | 6/1983 | Fleishman |
| 4,390,206 | A | 6/1983 | Faiks et al. |
| 4,406,496 | A | 9/1983 | Drabert et al. |
| 4,408,797 | A | 10/1983 | Franck et al. |
| 4,411,469 | A | 10/1983 | Drabert et al. |
| 4,415,203 | A | 11/1983 | Cawley |
| 4,418,958 | A | 12/1983 | Watkin |
| 4,429,917 | A | 2/1984 | Diffrient |
| 4,451,081 | A | 5/1984 | Kowalski |
| 4,456,298 | A | 6/1984 | Gottstein |
| 4,466,662 | A | 8/1984 | McDonald et al. |
| 4,479,679 | A | 10/1984 | Fries et al. |
| 4,491,364 | A | 1/1985 | Hattori et al. |
| 4,496,190 | A | 1/1985 | Barley |
| 4,498,702 | A | 2/1985 | Raftery |
| 4,502,731 | A | 3/1985 | Snider |
| 4,509,793 | A | 4/1985 | Wiesmann et al. |
| 4,515,406 | A | 5/1985 | Fujiyama et al. |
| D279,635 | S | 7/1985 | Aasen |
| 4,533,174 | A | 8/1985 | Fleishman |
| 4,534,593 | A | 8/1985 | Ojala |
| 4,540,217 | A | 9/1985 | Suzuki |
| 4,552,406 | A | 11/1985 | Ohi |
| 4,555,136 | A | 11/1985 | Dranger |
| 4,560,199 | A | 12/1985 | Sapper |
| 4,570,994 | A | 2/1986 | Lowrey |
| 4,580,837 | A | 4/1986 | Bayley |
| 4,585,272 | A | 4/1986 | Ballarini |
| 4,603,830 | A | 8/1986 | Franck |
| 4,627,602 | A | 12/1986 | Sporck |
| 4,640,548 | A | 2/1987 | Desanta |
| 4,641,885 | A | 2/1987 | Bräuning |
| 4,660,885 | A | 4/1987 | Suhr et al. |
| 4,660,887 | A | 4/1987 | Fleming et al. |
| D289,591 | S | 5/1987 | Groseth |
| 4,664,445 | A | 5/1987 | Groseth |
| 4,685,730 | A | 8/1987 | Linguanotto |
| 4,691,961 | A | 9/1987 | Rogers, Jr. et al. |
| 4,693,442 | A | 9/1987 | Sills |
| 4,693,515 | A | 9/1987 | Russo et al. |
| 4,703,974 | A | 11/1987 | Bräuning |
| 4,711,491 | A | 12/1987 | Ginat |
| 4,713,854 | A | 12/1987 | Graebe |
| 4,720,146 | A | 1/1988 | Mawbey et al. |
| 4,730,871 | A | 3/1988 | Sheldon |
| 4,733,910 | A | 3/1988 | Brennan |
| 4,752,101 | A | 6/1988 | Yurchenco et al. |
| 4,758,045 | A | 7/1988 | Edel et al. |
| D296,959 | S | 8/1988 | Gusrud |
| 4,761,033 | A | 8/1988 | Lanuzzi et al. |
| 4,765,679 | A | 8/1988 | Lanuzzi et al. |
| 4,776,633 | A | 10/1988 | Knoblock et al. |
| 4,778,218 | A | 10/1988 | Suman |
| 4,786,108 | A | 11/1988 | Dauphin |
| 4,796,952 | A | 1/1989 | Piretti |
| 4,811,986 | A | 3/1989 | Hattori et al. |
| 4,823,417 | A | 4/1989 | Fukuichi |
| 4,830,430 | A | 5/1989 | Schäfer |
| 4,848,837 | A | 7/1989 | Völkle |
| 4,848,838 | A | 7/1989 | McCrackin et al. |
| 4,852,943 | A | 8/1989 | Roper |
| 4,863,218 | A | 9/1989 | McCrackin |
| 4,869,448 | A | 9/1989 | Kenyon |
| 4,869,552 | A | 9/1989 | Tolleson et al. |
| 4,871,208 | A | 10/1989 | Hodgdon |
| 4,881,777 | A | 11/1989 | Dorshimer |
| 4,889,385 | A | 12/1989 | Chadwick et al. |
| 4,909,472 | A | 3/1990 | Piretti |
| 4,914,836 | A | 4/1990 | Horovitz |
| 4,915,449 | A | 4/1990 | Piretti |
| 4,951,995 | A | 8/1990 | Teppo et al. |
| 4,962,962 | A | 10/1990 | Machate et al. |
| 4,965,899 | A | 10/1990 | Sekido et al. |
| 4,981,326 | A | 1/1991 | Heidmann |
| 4,988,145 | A | 1/1991 | Engel |
| 5,009,466 | A | 4/1991 | Perry |
| 5,009,467 | A | 4/1991 | McCoy |
| 5,013,272 | A | 5/1991 | Watkins |
| 5,015,034 | A | 5/1991 | Kindig et al. |
| 5,022,709 | A | 6/1991 | Marchino |
| 5,024,484 | A | 6/1991 | Buchacz |
| 5,026,120 | A | 6/1991 | Takeda et al. |
| 5,029,822 | A | 7/1991 | Selzer |
| 5,039,567 | A | 8/1991 | Landi et al. |
| 5,044,027 | A | 9/1991 | Moon |
| 5,044,030 | A | 9/1991 | Balaton |
| 5,046,780 | A | 9/1991 | Decker et al. |
| 5,050,931 | A | 9/1991 | Knoblock |
| 5,050,933 | A | 9/1991 | Tornero et al. |
| 5,052,068 | A | 10/1991 | Graebe |
| 5,052,753 | A | 10/1991 | Buchacz |
| 5,076,643 | A | 12/1991 | Colasanti et al. |
| 5,080,430 | A | 1/1992 | Castro |
| 5,100,201 | A | 3/1992 | Becker, III et al. |
| 5,101,811 | A | 4/1992 | Brunswick |
| 5,102,196 | A | 4/1992 | Kaneda et al. |
| 5,108,150 | A | 4/1992 | Stas et al. |
| 5,113,540 | A | 5/1992 | Sereboff |
| 5,121,934 | A | 6/1992 | Decker et al. |
| 5,137,329 | A | 8/1992 | Neale |

5,144,708 A 9/1992 Pekar
5,171,209 A 12/1992 Gamba
5,172,436 A 12/1992 Masuda
5,190,348 A 3/1993 Colasanti
5,195,199 A 3/1993 Sereboff
5,251,958 A 10/1993 Roericht et al.
5,265,938 A 11/1993 Melhuish et al.
5,288,134 A 2/1994 Hewko et al.
D345,060 S 3/1994 Duncan
5,292,097 A 3/1994 Russell
5,304,271 A 4/1994 Gusakov
5,308,028 A 5/1994 Kornberg
5,308,142 A 5/1994 Forslund, III et al.
5,308,145 A 5/1994 Koepke et al.
5,314,235 A 5/1994 Johnson
5,314,237 A 5/1994 Koepke et al.
5,314,240 A 5/1994 Ishi et al.
5,318,347 A 6/1994 Tseng
5,320,409 A 6/1994 Katoh et al.
5,324,096 A 6/1994 Schultz
5,330,255 A 7/1994 Stawicki
5,340,191 A 8/1994 May
5,346,283 A 9/1994 Steininger et al.
5,346,284 A 9/1994 Dauphin
5,348,372 A 9/1994 Takamatsu et al.
5,348,415 A 9/1994 Carlsson
5,354,120 A 10/1994 Völkle
5,368,364 A * 11/1994 Kanai ..... 297/411.27
5,368,365 A 11/1994 Feldberg
5,372,487 A 12/1994 Pekar
5,380,065 A * 1/1995 Rohrer ..... 297/411.37
5,382,079 A 1/1995 Wilson et al.
5,388,892 A 2/1995 Tornero
5,393,124 A 2/1995 Neil
5,393,125 A 2/1995 Watson et al.
5,401,077 A 3/1995 Hosoe
5,415,459 A 5/1995 Schultz
5,417,473 A 5/1995 Braüning
5,419,617 A * 5/1995 Schultz ..... 297/411.27
5,435,626 A 7/1995 Lai
5,439,267 A 8/1995 Peterson et al.
5,444,881 A 8/1995 Landi et al.
5,452,937 A 9/1995 Piretti
5,484,187 A 1/1996 Doerner et al.
5,486,035 A 1/1996 Koepke et al.
5,505,521 A 4/1996 Meiller et al.
5,513,898 A * 5/1996 Kanai et al. ..... 297/411.27
5,524,966 A 6/1996 Piretti
5,542,743 A 8/1996 Olson et al.
5,547,252 A 8/1996 Pfenniger
5,558,399 A 9/1996 Serber
5,560,438 A 10/1996 Collee et al.
5,560,439 A 10/1996 Delwiche et al.
5,562,324 A 10/1996 Massara et al.
5,567,010 A 10/1996 Sparks
5,567,011 A 10/1996 Sessini
5,575,534 A 11/1996 Yu
5,577,807 A 11/1996 Hodge et al.
5,580,127 A 12/1996 Piretti
5,584,533 A 12/1996 Schrewe
5,586,810 A 12/1996 Liu
5,590,934 A 1/1997 Gibbs
5,595,806 A 1/1997 Korfmacher
5,597,208 A 1/1997 Bonutti
5,599,067 A 2/1997 Schuelke et al.
5,613,736 A 3/1997 Schaked et al.
5,617,595 A 4/1997 Landi et al.
5,620,233 A 4/1997 Corwin
5,630,647 A 5/1997 Heidmann et al.
5,637,076 A 6/1997 Hazard et al.
5,641,203 A * 6/1997 Van De Riet et al. .. 297/411.37
5,645,317 A 7/1997 Onishi et al.
5,647,638 A 7/1997 Ritt et al.
5,649,740 A 7/1997 Hodgdon
5,649,741 A 7/1997 Beggs
5,655,814 A * 8/1997 Gibbs ..... 297/411.38
5,664,842 A 9/1997 Tseng
5,666,861 A 9/1997 Fee et al.
5,667,277 A 9/1997 Van De Riet
5,669,665 A 9/1997 Nowak
5,676,483 A 10/1997 Koubek
5,678,891 A 10/1997 O'Neill et al.
5,704,688 A 1/1998 Schrewe et al.
5,711,575 A 1/1998 Hand et al.
5,713,631 A 2/1998 O'Neill et al.
5,725,277 A 3/1998 Knoblock
5,749,628 A 5/1998 Synder et al.
5,765,804 A 6/1998 Stumpf et al.
5,765,914 A 6/1998 Britain et al.
5,765,919 A 6/1998 Karlsson et al.
5,769,497 A * 6/1998 Tsai ..... 297/411.36
5,772,282 A 6/1998 Stumpf et al.
5,775,774 A 7/1998 Okano
5,791,733 A 8/1998 van Hekken et al.
5,791,735 A 8/1998 Helman
5,791,736 A 8/1998 Herbert
5,795,026 A 8/1998 Dral et al.
5,797,652 A 8/1998 Darbyshire
5,806,927 A 9/1998 Schneider
5,810,439 A 9/1998 Roslund, Jr.
5,823,619 A 10/1998 Heilig et al.
5,826,940 A 10/1998 Hodgdon
5,829,721 A * 11/1998 Jurik et al. ..... 248/118
5,829,839 A 11/1998 Wilkerson et al.
5,839,786 A 11/1998 Cvek
5,845,964 A 12/1998 Phoon
5,848,823 A 12/1998 Su
5,853,223 A 12/1998 Ritt et al.
5,860,699 A 1/1999 Weeks
5,860,701 A 1/1999 Jungjohann et al.
5,868,466 A 2/1999 Massara et al.
5,868,467 A 2/1999 Moll
5,871,258 A 2/1999 Battey et al.
5,876,097 A * 3/1999 Cao ..... 297/411.37
5,884,975 A 3/1999 Su
5,890,245 A 4/1999 Klearman et al.
5,895,095 A 4/1999 Chen
5,902,011 A 5/1999 Hand et al.
5,904,397 A 5/1999 Fismen
5,909,923 A 6/1999 DeKraker
5,909,924 A 6/1999 Roslund, Jr.
5,918,940 A 7/1999 Wakamatsu et al.
5,927,804 A 7/1999 Cuevas
5,927,811 A * 7/1999 Tseng ..... 297/353
5,931,531 A 8/1999 Assmann
5,931,536 A 8/1999 Wu
5,931,537 A * 8/1999 Gollin et al. ..... 297/411.36
5,934,749 A 8/1999 Pond et al.
5,934,758 A 8/1999 Ritch et al.
D413,875 S 9/1999 Lawrence
5,951,109 A 9/1999 Roslund, Jr. et al.
5,954,393 A 9/1999 Perrin
5,957,534 A 9/1999 Wilkerson et al.
5,964,503 A 10/1999 Inoue
5,967,608 A 10/1999 Van Sickle
5,967,613 A 10/1999 McKeever
5,971,481 A 10/1999 Emmenegger et al.
5,971,484 A 10/1999 Lamart et al.
5,975,632 A 11/1999 Ginat
5,975,634 A 11/1999 Knoblock et al.
5,975,636 A 11/1999 Koch et al.
5,975,637 A 11/1999 Geuss et al.

5,975,639 A 11/1999 Wilson et al.
5,979,984 A 11/1999 DeKraker et al.
D417,793 S 12/1999 Ritch et al.
5,997,093 A 12/1999 Gollin et al.
5,997,094 A 12/1999 Cvek
6,010,189 A 1/2000 Hybarger et al.
6,015,187 A 1/2000 Roslund, Jr. et al.
6,017,091 A 1/2000 Cao
6,022,078 A 2/2000 Chang
6,027,169 A 2/2000 Roslund, Jr.
6,030,041 A 2/2000 Hsiao
6,035,901 A 3/2000 Stumpf et al.
6,039,397 A 3/2000 Ginat
D423,261 S 4/2000 Ritch et al.
6,045,183 A 4/2000 Weber
6,045,191 A 4/2000 Piretti
6,050,634 A 4/2000 Yamagishi et al.
6,053,574 A 4/2000 Opsvik
6,053,577 A 4/2000 Arko et al.
6,053,578 A 4/2000 van Hekken et al.
6,053,579 A 4/2000 Nelson et al.
6,056,360 A 5/2000 Schneider
6,059,363 A 5/2000 Roslund, Jr. et al.
6,059,368 A 5/2000 Stumpf et al.
6,059,370 A 5/2000 Kanyer et al.
6,062,646 A 5/2000 Bock
6,062,647 A 5/2000 Mei
6,074,012 A 6/2000 Wu
6,076,892 A 6/2000 van Hekken et al.
6,079,785 A 6/2000 Peterson et al.
6,086,153 A 7/2000 Heidmann et al.
6,098,000 A 8/2000 Long et al.
6,106,069 A 8/2000 Bock
6,106,070 A * 8/2000 Ritt et al. ..... 297/411.35
6,116,688 A 9/2000 Wilkerson et al.
6,120,096 A 9/2000 Miotto
6,120,099 A 9/2000 Reikerås et al.
6,129,419 A 10/2000 Neale
6,132,001 A 10/2000 Su
6,139,106 A 10/2000 Aldridge
6,139,107 A 10/2000 Lee
D433,854 S 11/2000 Diffrient
6,149,231 A 11/2000 Wüstholz
6,149,236 A 11/2000 Bräuning
D435,746 S 1/2001 Diffrient
D436,457 S 1/2001 Ambasz
D436,749 S 1/2001 Arad
6,168,236 B1 1/2001 Chen
6,168,237 B1 1/2001 Lamert et al.
6,168,239 B1 1/2001 Conner et al.
6,174,031 B1 1/2001 Lindgren et al.
6,176,548 B1 1/2001 Thole et al.
6,176,550 B1 1/2001 Lamert et al.
D437,497 S 2/2001 Bräuning
D437,701 S 2/2001 Bellini et al.
6,182,315 B1 2/2001 Lee
6,186,594 B1 2/2001 Valiquette et al.
6,192,565 B1 2/2001 Tame
D439,450 S 3/2001 Perl
D440,068 S 4/2001 Bräuning
6,209,840 B1 4/2001 Chen
6,209,958 B1 4/2001 Thole
6,209,961 B1 4/2001 Chen
6,213,556 B1 * 4/2001 Chen ..... 297/411.35
6,227,511 B1 * 5/2001 De Costa ..... 248/311.2
6,279,184 B1 8/2001 George, II
6,286,900 B1 9/2001 Roark
6,290,295 B1 9/2001 Benden et al.
6,295,674 B1 10/2001 Smith-McKelvey et al.
6,296,308 B1 10/2001 Cosentino et al.
6,296,312 B1 10/2001 Congleton et al.
6,296,313 B1 10/2001 Wu
6,302,486 B1 10/2001 Lamart et al.
6,315,362 B1 11/2001 Chuang
6,318,800 B1 11/2001 DeKraker
6,336,680 B1 1/2002 Lee
6,343,839 B1 2/2002 Simons, Jr. et al.
6,349,992 B1 2/2002 Knoblock et al.
6,386,634 B1 5/2002 Stumpf et al.
6,394,545 B2 5/2002 Knoblock et al.
6,422,652 B1 7/2002 Roslund, Jr. et al.
6,460,932 B1 * 10/2002 Kopish et al. ..... 297/411.36
6,497,392 B1 * 12/2002 Perkins ..... 248/118
2001/0000939 A1 5/2001 Roslund, Jr. et al.
2002/0096920 A1 7/2002 Watson et al.
2002/0149247 A1 10/2002 Diffrient

FOREIGN PATENT DOCUMENTS

DE 43 17 610 A1 12/1994
DE 94 14 023.5 2/1995
DE 295 02 429 U1 12/1995
DE 297 06 901 U1 7/1997
DE 196 03 789 A1 8/1997
DE 197 16 347 A1 10/1998
DE 198 48 400 A1 5/2000
EP 0 032 839 A2 7/1981
EP 0 154 582 A2 9/1985
EP 0 164 266 A2 11/1985
EP 0 164 267 A2 12/1985
EP 0 166 870 A1 1/1986
EP 0 216 578 A2 4/1987
EP 0 249 584 A2 12/1987
EP 0 277 912 A1 8/1988
EP 0 338 050 B1 10/1989
EP 0 499 594 A1 8/1992
EP 0 383 890 1/1993
EP 0 560 736 A1 9/1993
EP 0 561 518 A1 9/1993
EP 0 587 537 A1 3/1994
EP 0 589 190 A1 3/1994
EP 0 589 834 A1 3/1994
EP 0 591 932 A1 4/1994
EP 0 591 933 A1 4/1994
EP 0 741 985 A1 11/1996
EP 0 801 913 A1 10/1997
EP 0 809 957 A2 12/1997
EP 0 836 819 A2 4/1998
EP 0 857 443 A2 8/1998
EP 0 880 921 A2 12/1998
EP 0 885 575 A2 12/1998
EP 0 958 765 A2 11/1999
EP 0 960 586 A2 12/1999
EP 0 963 721 A1 12/1999
EP 1 013 198 A2 6/2000
EP 1 033 098 A1 9/2000
EP 1 044 634 A1 10/2000
EP 1 057 428 A1 12/2000
EP 1 059 051 A1 12/2000
EP 1 106 110 A1 6/2001
EP 1 161 903 A2 12/2001
EP 1 226 773 A1 7/2002
FR 2 558 360 7/1985
FR 2 586 180 2/1987
FR 2 586 541 3/1987
FR 2 641 453 7/1990
GB 1 222 908 2/1971
GB 2 057 257 A 4/1981
GB 2 068 717 A 8/1981
GB 1 603 355 11/1981
GB 1 603 356 11/1981
GB 2 107 576 A 5/1983
GB 2 165 445 A 4/1986

| | | | |
|---|---|---|---|
| GB | 2 189 990 | A | 11/1987 |
| GB | 2 232 884 | A | 1/1991 |
| GB | 2 255 008 | A | 10/1992 |
| GB | 2 255 277 | A | 11/1992 |
| NZ | 184194 | | 2/1981 |
| WO | WO 80/02791 | | 12/1980 |
| WO | WO 87/04909 | | 8/1987 |
| WO | WO 89/03648 | | 5/1989 |
| WO | WO 90/00871 | | 2/1990 |
| WO | WO 90/02504 | | 3/1990 |
| WO | WO 91/03969 | | 4/1991 |
| WO | WO 92/03073 | | 3/1992 |
| WO | WO 92/06622 | | 4/1992 |
| WO | WO 93/03653 | | 3/1993 |
| WO | WO 93/25121 | | 12/1993 |
| WO | WO 94/08491 | | 4/1994 |
| WO | WO 94/24904 | | 11/1994 |
| WO | WO 95/00052 | | 1/1995 |
| WO | WO 95/28866 | | 11/1995 |
| WO | WO 96/02166 | | 2/1996 |
| WO | WO 96/07344 | | 3/1996 |
| WO | WO 96/39900 | | 12/1996 |
| WO | WO 96/39901 | | 12/1996 |
| WO | WO 96/39902 | | 12/1996 |
| WO | WO 96/39903 | | 12/1996 |
| WO | WO 97/23152 | | 7/1997 |
| WO | WO 98/02067 | | 1/1998 |
| WO | WO 98/08424 | | 3/1998 |
| WO | WO 98/32353 | | 7/1998 |
| WO | WO 98/47413 | | 10/1998 |
| WO | WO 98/48668 | | 11/1998 |
| WO | WO 98/48670 | | 11/1998 |
| WO | WO 99/21456 | | 5/1999 |
| WO | WO 99/27820 | | 6/1999 |
| WO | WO 00/22959 | | 4/2000 |
| WO | WO 00/22960 | | 4/2000 |
| WO | WO 00/23027 | | 4/2000 |
| WO | WO 00/24295 | | 5/2000 |
| WO | WO 00/24296 | | 5/2000 |
| WO | WO 00/53058 | | 9/2000 |
| WO | WO 00/64311 | | 11/2000 |
| WO | WO 00/72730 | A1 | 12/2000 |
| WO | WO 00/74531 | A1 | 12/2000 |
| WO | WO 01/03548 | A1 | 1/2001 |
| WO | WO 01/39633 | A1 | 6/2001 |

* cited by examiner

ARM ASSEMBLY FOR A CHAIR

CROSS-REFERENCE TO RELATED APPLICATIONS

The present application claims priority from U.S. provisional application serial No. 60/236,925, filed Sep. 28, 2000, and entitled AMR ASSEMBLY FOR A CHAIR, which provisional application is incorporated herein by reference in its entirety.

BACKGROUND OF THE INVENTION

1. The Field of the Invention

The present invention relates to an arm assembly. In particular, although not exclusively, the invention relates to an arm assembly for an office chair where the armrest is adjustable for the comfort of the occupant. The invention also relates to a detachable arm assembly enabling the arm of a chair to be removed or substituted for another type e.g. a writing tablet. While the invention is described herein in terms of an office chair, it will be understood that the invention can be implemented in any type of chair including a wheelchair. Moreover, the invention might also have application beyond chairs. Arm assemblies of the invention may be attachable to a table or workstation, for example to be used as typists' aids.

2. The Relevant Technology

Human beings come in all different shapes and sizes. For this reason, office chairs generally allow for adjustment e.g. seat height, seat depth. It is also known to provide for adjustment of armrests. A known adjustment includes a twisting action about a vertical axis. Another known type permits a twisting action as well as sideways movement. Another known type permits motion of the armrest in a predetermined oval path within a horizontal plane. Seat depth adjustment is one of the major adjustments required by an occupant of a chair and is to be commonly found on commercial office chairs. As the occupant adjusts their seat depth, the positioning of the armrests relative to the seat will vary even to the extent that the positioning of the armrests may be totally inappropriate for the occupant. Known office chairs do not satisfactorily meet the requirement of being easily adjustable to accommodate the seat depth position.

Another shortcoming of known armrest adjustment mechanisms is that they are not easy to adjust. In some known types, the user must reach under the armrest to effect the adjustment or alternatively use the opposite hand to make the adjustment. Adjustment in this fashion is awkward and cumbersome.

Yet another shortcoming of some of the known adjustable armrests is that they rely on force for adjustment. Therefore, while the occupant is using the chair in the normal fashion, the armrest will function as intended in the position selected by the user. However, if the user unintentionally bears considerable force against the armrests they can move. This often occurs when the occupant uses the armrests to lift himself out of the chair. This can be destabilising to the occupant and moreover, requires the occupant to re-adjust the armrests when he resumes occupancy of the chair.

It is therefore an object of the present invention to provide an armrest assembly which overcomes or at least addresses some of the foregoing disadvantages.

BRIEF SUMMARY OF THE INVENTION

In accordance with a first aspect of the present invention there is provided an arm assembly for a chair wherein the chair has a forward direction and a rearward direction, said arm assembly comprising: an armrest; a support structure; a mounting device movably mounting the armrest to the support structure, wherein the mounting device constrains the movement of the armrest relative to the support structure to movement in a substantially horizontal plane having two degrees of freedom defined by first and second transversely arranged axes lying within the substantially horizontal plane to move in a substantially planar fashion without changing the orientation of the armrest.

It will be understood that the invention need not be limited to travel along the two pre-determined axes. It will be understood that the invention includes within its scope that the armrest is moveable along paths parallel to the first axis and additionally along paths parallel to the second axis. Thus the armrest may be permitted to move in a grid pattern. Additionally, the armrest is moveable in any direction along the substantially horizontal plane incorporating both the first and second axes. Suitably, the movement along the plane is within predetermined limits.

It is also preferred that the mounting device enables the armrest to adopt any one of a plurality of adoptable positions defined by the intersection of coordinate locations along the first and second axes. The term adoptable positions is thereby defined.

In a most preferred form of the invention, the first axis is generally aligned with the forward direction of the chair. Furthermore, the armrest might also be elongate in form with its longitudinal axis aligned with the forward direction of the chair. If the first axis is aligned with the forward direction of the chair then movement of the armrest along the second axis (or paths parallel thereto) will be in the sideways direction of the chair.

In accordance with a second aspect of the present invention there is provided an arm assembly for a chair having a forwards direction and a transverse direction, said arm assembly having a longitudinal axis such that the arm assembly is adapted to be assembled with the chair with the longitudinal axis of the arm assembly corresponding substantially to the forward direction of the chair, the arm assembly further having a transverse axis arranged such that with the arm assembly assembled with the chair, the transverse axis corresponds to the transverse direction of the chair; said arm assembly further comprising: an armrest; a support structure attachable to the chair, the armrest being mounted to the support structure by way of a mounting device such that the armrest is selectively moveable relative to the support structure forwards and backwards to adopt any one of a plurality of coordinate locations along the longitudinal axis and side to side to adopt any one of a plurality of coordinate locations along the transverse axis whereby the armrest is selectively positionable in any one of a plurality of adoptable positions defined by its respective coordinate locations along the longitudinal and transverse axes, the mounting device incorporating a locking device to releasably lock the armrest in any one of the adoptable positions.

The following discussion of optional features may be applicable to either of the first or second aspects of the invention set out above.

The invention may be further provided with guides to guide the movement along the first/longitudinal and second/transverse axes. The first guide may be provided on part of the mounting device, to guide movement of the armrest relative thereto with a corresponding first guided portion on the armrest. A second guide may be provided in fixed relationship to the support structure with a corresponding second guided portion provided on said part of the mounting device. In a preferred form of the invention, the first guide is provided on a carrier having the second guided portion for engagement with the second guide secured relative to the support structure to allow movement of the carrier relative to the support structure.

Preferably, the first guide is in the form of spaced tracks. Accordingly, there may be two corresponding first guided portions for engagement with the parallel spaced tracks. These may take the form of slots or channels provided on the armrest. Alternatively, the arrangement could be reversed with the first guide in the form of slots or channels with the first guided portions being in the form of one or more projections engageable in the slots or channels.

Similarly, the second guide may be in the form of a pair of parallel spaced opposed edges forming a part fixed relative to the support structure. The second guided portion may simply comprise the carrier being shaped for sliding engagement with the opposed edges.

Suitably, the length of the guides may determine the range of travel along the first and second axes. Stops may be provided to limit the range of travel along the first and second axes. As determined by the guides or by stops, the range of movement along the first axis may be larger than the range of movement along the second axis. For example, the range of movement in the forward/reverse direction may be greater than the range of movement permitted in the side to side direction.

The mounting device may enable the armrest to adopt any one of a finite number of adoptable positions. However, within the scope of the invention is the provision that there may be in infinite number of adoptable positions.

Where the mounting device enables the armrest to adopt any one of a plurality of adoptable positions defined by the intersection of coordinate locations of the first and second axes then it is preferred that there is a finite number of coordinate locations along the first and second axes with a resultant finite number of adoptable positions. This leads to a grid pattern of adoptable positions. With this in mind, there may be provided a fixed portion mounted in fixed disposition relative to at least the upper part of the support structure. This fixed portion could be part of the mounting device or alternatively an integral part of the support structure. The fixed portion may include a plurality of first engagement portions, there being a second engagement portion carried with the armrest for engagement with at least some of the first engagement portions. Alternatively, the plurality of first engagement portions may be carried with the armrest with the second engagement portion fixed relative to the support structure for engagement with at least some of the first engagement portions. In either case set out above, the arrangement of said some of the first engagement portions is such that each defines an adoptable position of the armrest when the second engagement portion is engaged therewith. In a preferred form of the invention, the arrangement of the first engagement portions may be in a grid pattern with the second engagement portion able to engage with at least some of the first engagement portions of the grid pattern.

The first and second engagement portions are shaped to enable engagement therebetween. Accordingly, in a preferred form of the invention, the second engagement portion may take the form of a discrete engagement member or an engagement projection. The first engagement members may be correspondingly shaped recesses/slots/holes to engagingly receive the engagement member or the engagement projection. In a most preferred form of the invention, the second engagement member is in the form of a ball and the first engagement members are in the form of dimples, shaped to receive the ball. In a most preferred form of the invention, the ball is carried by the armrest and the dimples are provided on the fixed portion fixed relative to the support structure. Accordingly, the fixed portion may include a dimple pad.

The recesses/slots/holes may have bevelled edges to enable the engagement members/engagement projections to be guided into position. Therefore, the ball and dimples arrangement is particularly preferred for the reason that the ball is easily locatable within any one of the dimples.

Where the second engagement portion is provided in the form of a discrete member e.g. ball, roller, the ball/roller may be normally biased into a position for engagement with one of the first engagement members.

Conversely, the first engagement portions may comprise discrete engagement members or engagement projections such as nodules. Additionally, the second engagement portion may be formed as a recess/slot/hole to receive one of the first engagement members or projections.

In another specific form of the invention, the first engagement members may be in the form of rollers with the second engagement portion being shaped as a trough-shaped recess to receive any one of at least some of the rollers.

In a preferred form of the invention, the plurality of first engagement portions are provided on the fixed portion. The fixed portion may extend forwardly or rearwardly of the carrier. Alternatively, the fixed portion may extend out partly forwardly and partly rearwardly of the carrier. This is the preferred form because in this way, the two sides of the fixed portion define opposing guides for the carrier. Some of the first engagement portions e.g. dimples, may also be provided on the carrier. This is particularly preferred where the carrier is centrally located. Therefore, there may be more than one second engagement portions. Preferably, there are two engagement portions e.g. two balls, with the arrangement of corresponding first engagement portions e.g. dimples, on the carrier being such that both second engagement portions are not engageable with the carrier at the same time. Where it is desirable to lock the armrest into position, this arrangement will preclude the armrest from being locked to the moveable carrier which is essentially a non-locking configuration of the armrest.

In a most preferred form of the invention, there are two balls carried by the armrest and two portions of the dimple pad are arranged forwardly and rearwardly respectively of a centrally disposed carrier with further dimples arranged on the carrier with three dimples extending across the width of the carrier wherein the spacing between the outermost dimples on the carrier is less than the spacing of the two balls such that with one of the balls engaging the carrier, the other ball engages with one or other of the portions of the dimple pad. The two balls could be discrete balls but alternatively could be joined.

In an alternative less preferred form of the invention, there may be one or more balls disposed on the fixed portion with the armrest carrying the dimple pad such that the dimple pad can engage with the balls and adopt any one of the plurality of adoptable positions.

It will be also appreciated that the invention is not limited to balls and a dimple pad. For example, the fixed portion may comprise one or more projections e.g. nodules. The arm portion may carry one or more dimple portions shaped for engagement with the nodules with the arrangement of nodules and dimples enabling the arm portion to adopt any one of the plurality of adoptable positions.

The armrest may be lockable in any one of the adoptable positions. In this regard, the armrest may be selectively lockable. However, it is preferred that the armrest is normally locked in each of the adoptable positions with a release device being provided to unlock the armrest from its adopted position. As such, the release device may release the engagement between the first and second engagement portions. The release device may be in the form of a separator to separate the second engagement portion out of engagement with the first engagement portion. Preferably, the separator is in the form of a moveable slide having an engagement position whereby the first and second engagement portions are in engagement and a release position allowing disengagement of the first and second engagement portions. Where the first engagement portions are in the form of a recesses and the second engagement portion comprises discrete engagement members then the moveable slide may include a shaped recess of graduated or varying depth with a shallow part and a deep part, with the engagement position of the slide corresponding to the discrete engagement member being received in the shallow part and the release position of the slide corresponding to the discrete engagement member being received in the deep part. The slide may be biased towards the engagement position.

In an alternative form of the invention where the first engagement portion comprises a plurality of projections e.g. nodules and the second engagement portion comprises a correspondingly shaped recess provided on the slide member, the slide may include an inclined surface opposite the recess which is in engagement with a ramped surface, whereby the slide is slidable along the ramped surface to allow the recess of the slide to lift out of engagement with the engaged nodule.

The release device may be directly operable by the user. Alternatively, the release device may incorporate an actuator. Preferably, the actuator is disposed for easy reach of the hand of a user whose corresponding arm is supported by the armrest.

The armrest may be elongate in shape to support a forearm of the chair occupant. A flat upper surface may be provided although a trough-shaped armrest is also possible. The preferred shape is convex both in X and Y planes. Preferably, the upper surface of the armrest is padded for comfort.

In accordance with yet another aspect of the present invention there is provided an arm assembly for a chair having a forwards direction and a transverse direction, said arm assembly having a longitudinal axis such that the arm assembly is adapted to be assembled with the chair with the longitudinal axis of the arm assembly corresponding substantially to the forward direction of the chair, the arm assembly further having a transverse axis arranged such that with the arm assembly assembled with the chair, the transverse axis corresponds to the transverse direction of the chair; said arm assembly further comprising: an armrest; a support structure attachable to the chair, the armrest being selectively moveable relative to the chair forwards and backwards to adopt any one of a plurality of coordinate locations along the longitudinal axis and side to side to adopt any one of a plurality of coordinate locations along the transverse axis whereby the armrest is selectively positionable in any one or a plurality of adoptable positions defined by its respective coordinate locations along the longitudinal and transverse axes; a locking device to releasably lock the armrest in any one of the adoptable positions wherein the locking device is operable by a user's hand positioned on the armrest.

Any of the features discussed in connection with any of the foregoing aspects of the invention may be incorporated into the abovementioned aspect.

The armrest assembly according to any of the foregoing aspects of the invention may be incorporated into a chair. Suitably two armrests will be incorporated into each chair. Preferably, the chair is an office chair. The armrest may also be incorporated into a wheelchair or used as a typist's aid at a workstation.

The chair and arm assembly may be designed such that the support structure is detachable from the chair. The support structure may comprise a column-like portion supporting the mounting device at its upper end. The column-like portion may include a height adjustment mechanism to enable the height of the armrest to be adjusted to suit the chair occupant. The lower end of the column-like portion may be connected to an attachment portion for detachable connection of the arm assembly to the chair.

In accordance with yet another aspect of the present invention there is provided a chair including: a main assembly having a seat portion, a back portion, and a support frame supporting the seat portion and the back portion; an arm assembly detachable from the main assembly, the arm assembly comprising: an armrest; a support structure having an upper end and a lower end, the support structure supporting the armrest at its upper end; and an elongate attachment portion disposed at or adjacent the lower end of the support structure, the elongate attachment portion having an external surface and including male engagement portions in defined areas of the external surface, the engagement portions including an outer male engagement surface and an inner male engagement surface spaced from each other; the main assembly further including an arm attachment portion in the form of a bore to receive the elongate attachment portion, the surface of the bore including female engagement portions in defined areas of the bore, the female engagement portions including an outer female engagement surface and an inner female engagement surface, the inner and outer female engagement surfaces being shaped and disposed such that upon insertion of the elongate attachment portion into the arm attachment portion, the outer male engagement surface and the inner male engagement surface are caused to releasably engage with the inner female engagement surface and the outer female engagement surface respectively wherein the male engagement surfaces are formed on portions of the elongate attachment portion which are non-tapering and of small length in comparison to the length of the elongate attachment portion.

In a preferred form of the invention, the elongate attachment portion is downwardly inclined relative to the support structure. In this way, any downward force applied to the armrest will be resolved in the elongate attachment portion in a manner tending to push the elongate attachment portion into the arm attachment portion of the main assembly. A force in the upright direction applied to the armrest will also resolve in the elongate attachment portion in the same manner due a cantilever effect.

The arm attachment portion which includes the female engagement surfaces may be disposed on any part of the chair such as the seat portion or a lower region of the back portion. In a most preferred form of the invention the arm attachment portion is disposed on the support frame. The support frame may include a main transom supported by a pneumatic spring. It is desirable that the arm attachment portion is defined at one end of the main transom.

Preferably, the length of the mutual engagement between the outer male engagement surface and the inner female engagement surface is less than 5 mm. Likewise, it is preferred that the length of the mutual engagement of the inner male engagement surface and the outer female engagement surface is less than 5 mm.

Preferably, the portions of the elongate attachment portion including the male engagement surfaces are of uniform cross-section. The cross-sections of the mutually engaging engagement surfaces should naturally correspond. The outer male engagement surface may be provided at the end of the elongate attachment portion but not necessarily so. An intermediate portion is defined between the outer male engagement surface and the inner male engagement surface. This may be of any shape including tapering, provided that it does not interfere with the insertion of the elongate attachment portion into the arm attachment portion.

The arm attachment portion could be a hollow member. However in a more preferred form of the invention, the arm attachment portion comprises first and second bands incorporated into the transom.

A clip may also be provided to prevent inadvertent detachment of the arm assembly from the main assembly. Preferably, the clip is normally locked with an actuator provided to disengage the clip and release the elongate attachment portion from the main assembly attachment portion.

In accordance with a further aspect of the invention there is provided an armrest for a chair, wherein the armrest incorporates a guide and slide member slidably mounted thereto, the slide member accommodating an optical disc which provides operating instructions for the chair, the slide member being moveable along the guide between a retracted position and an extended position in which an occupant of the chair can access the optical disc.

Preferably, the slide member is manually operable by the user. Preferably, the slide is moveable from the retracted position fully received within the armrest, to an extended position forward of the armrest, the slide member extending through a forward opening in the armrest.

This invention may also be said broadly to consist in the parts, elements and features referred to or indicated in the specification of the application, individually or collectively, and any or all combinations of any two or more of said parts, elements or features, and where specific integers are mentioned herein which have known equivalents in the art to which this invention relates, such known equivalents are deemed to be incorporated herein as if individually set forth.

The invention consists in the foregoing and also envisages constructions of which the following gives examples.

BRIEF DESCRIPTION OF THE DRAWINGS

In order that the invention may be more fully understood, one embodiment will now be described by way of example with reference to the drawings in which.

DETAILED DESCRIPTION OF THE PREFERRED EMBODIMENTS

Figure 1:
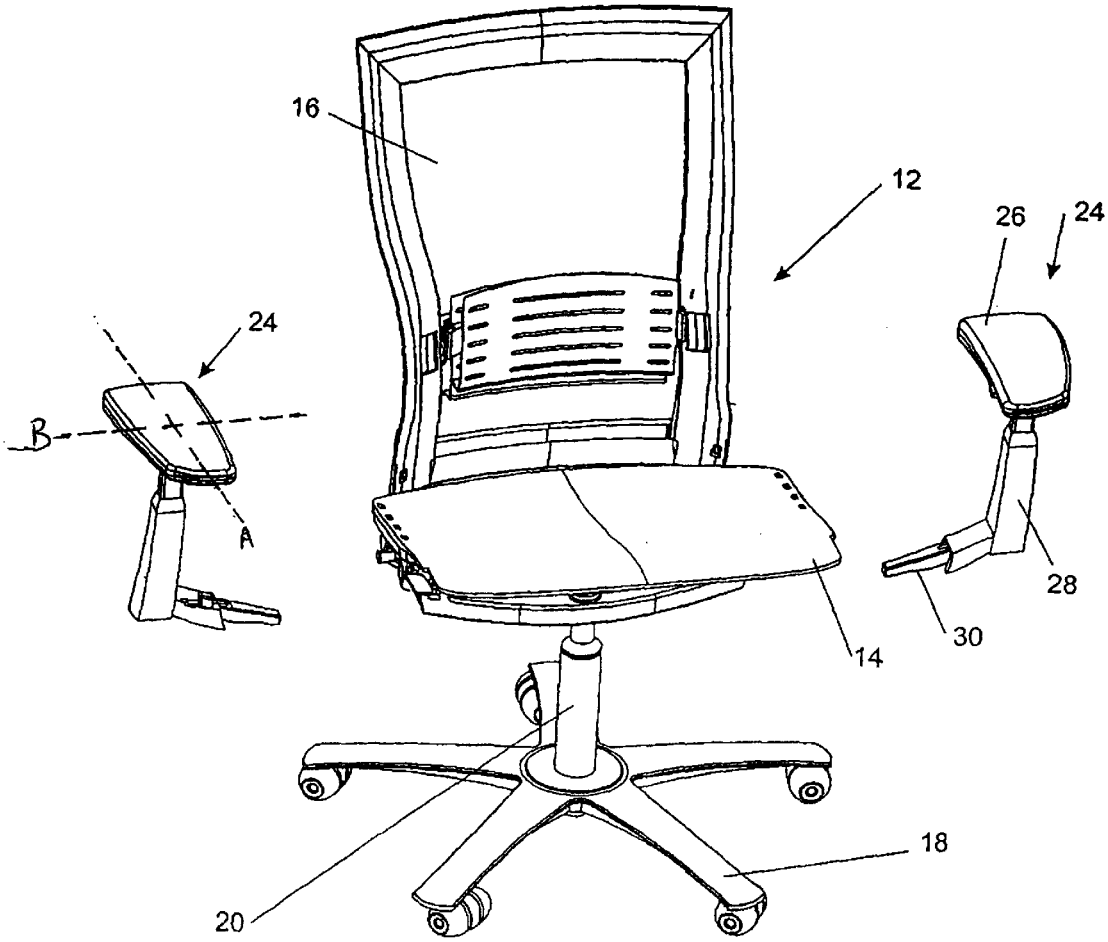
FIG. 1 is an exploded perspective view illustrating a chair with two detachable arm assemblies according to a preferred embodiment of the present invention.

FIG. 1 illustrates an office chair including a main assembly 12 having a seat portion 14 and a back portion 16. The seat portion 14 and the back portion 16 are supported above the ground by a support frame including a wheeled base 18 and a central support column 20. The support frame also includes a mechanism enabling the back portion 16 to recline with a synchronous tilting action of the seat portion 14 as the back portion 16 reclines. The details of the mechanism are not important to the present invention and the reader may refer to our co-pending patent application Ser. No. 60/236,925, the details of which are incorporated by reference herein. The central support column 20 houses a pneumatic spring (not shown) for height adjustment of the seat portion 14 in conventional fashion. The pneumatic spring is connected to the main transom 22 of the chair which is not illustrated in FIG. 1 but shown in FIG. 2. The main transom 22 extends transversely across the chair and is connected to the pneumatic spring by way of central spring connection ring 23.

Figure 3:
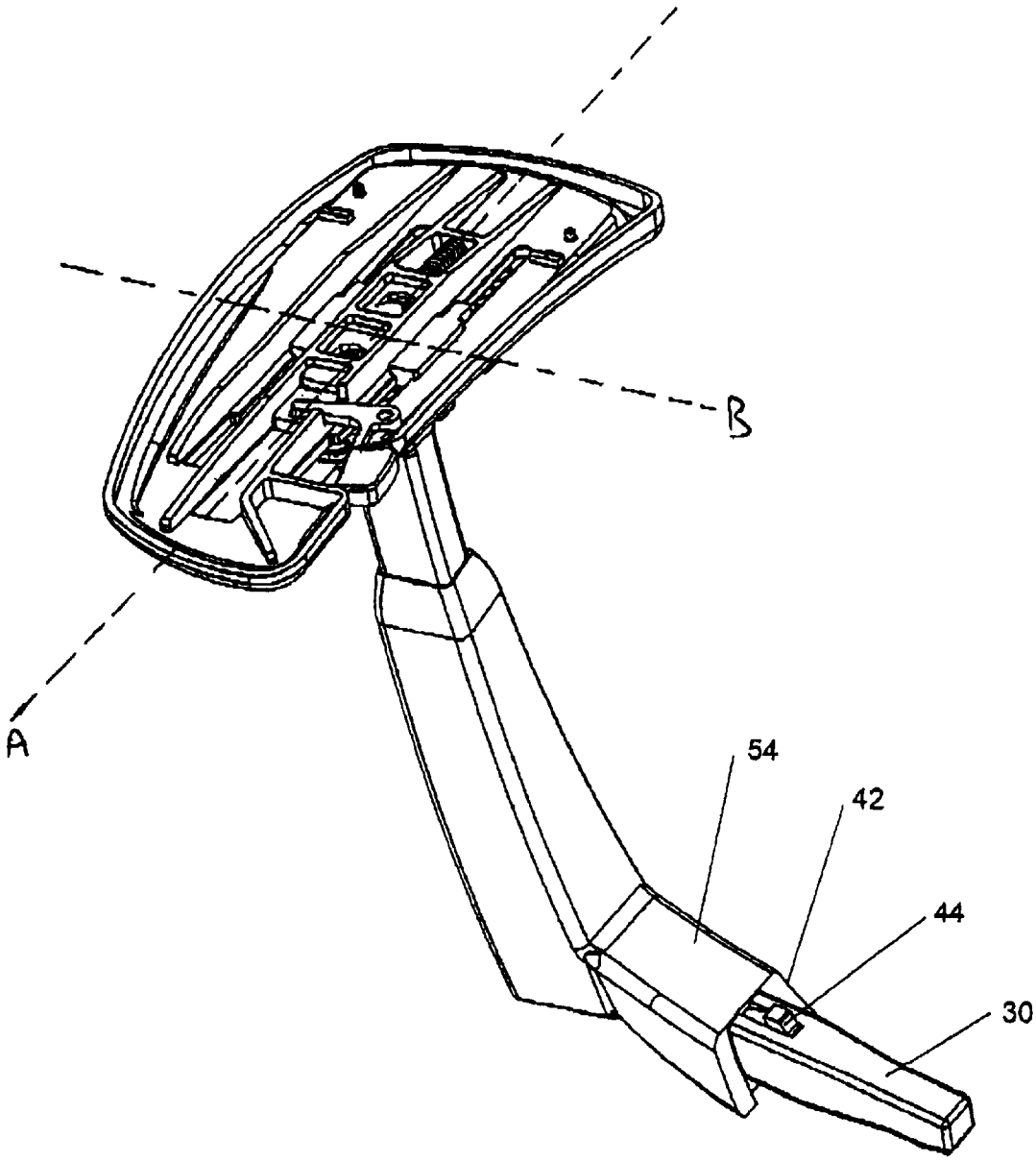
FIG. 3 is a perspective view of the arm assembly with the upper padding removed.
Figure 4:
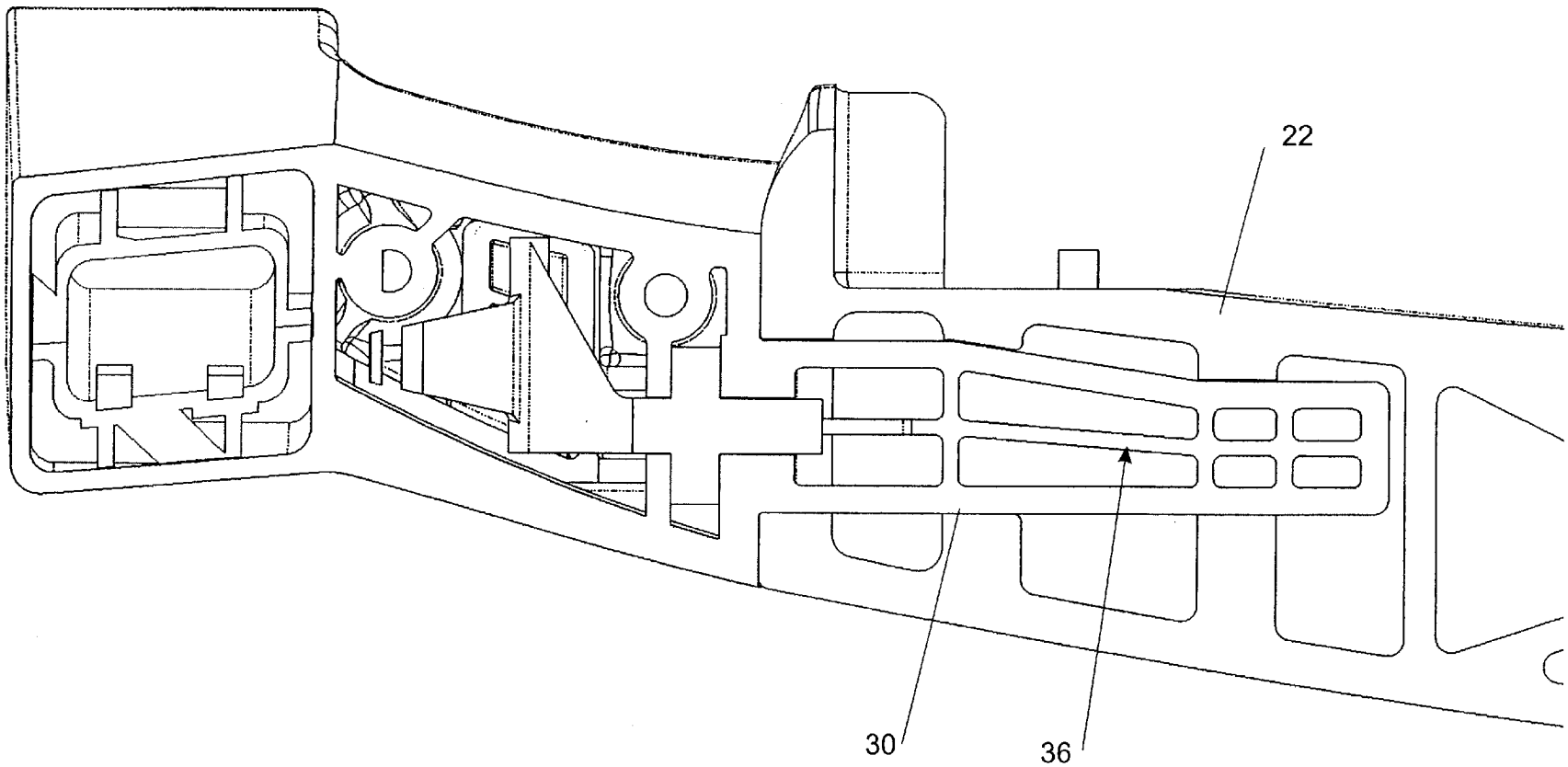
FIG. 4 is a horizontal sectional view through the lower part of the arm assembly of FIG. 3 looking from below.

FIG. 1 also illustrates two detachable arm assemblies 24. The arm assemblies 24 include an upper armrest 26 which is padded for user comfort. Each arm assembly also includes an upright support structure 28. The armrest 26 is mounted to the upper end of the upright support structure 28. The lower end of the upright support structure has an elongate attachment portion 30 extending inwardly therefrom in a downwardly inclined angle as shown in FIG. 3.

Figure 2:
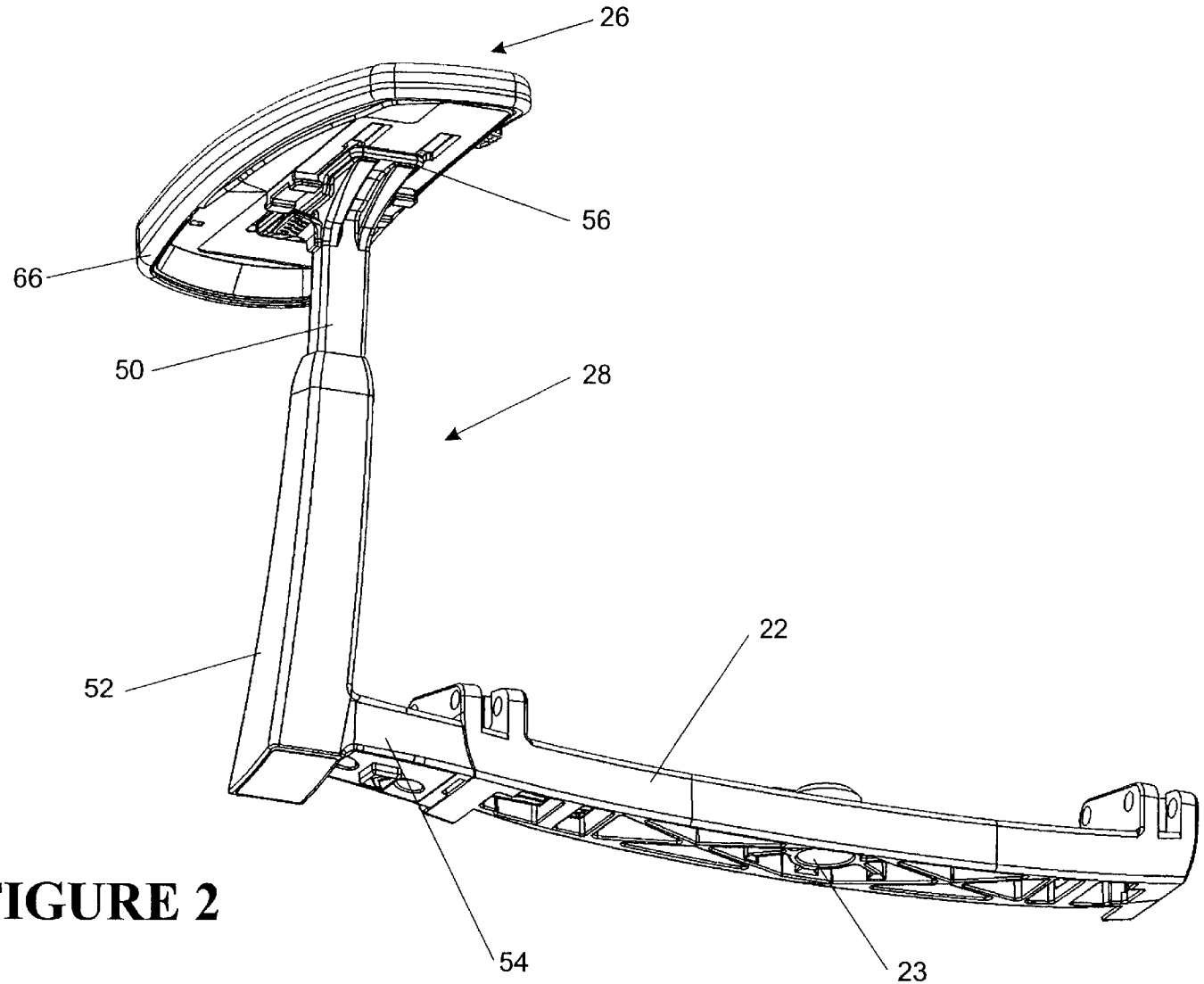
FIG. 2 is a detailed view of a portion of the chair shown in FIG. 1 illustrating attachment of one of the arm assemblies.
Figure 5A:
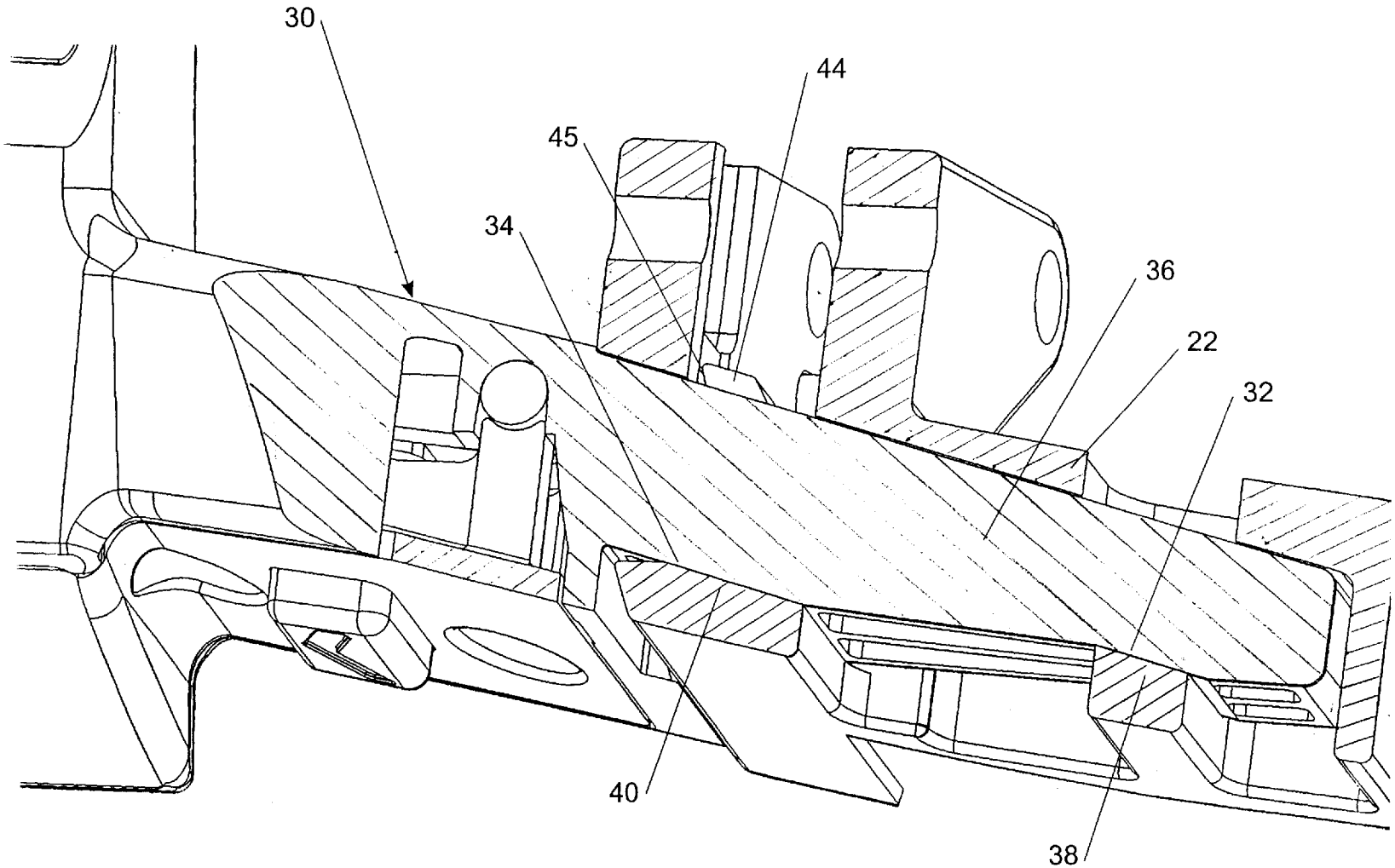
FIG. 5*a* is a perspective view of the lower part of the arm assembly of FIG. 3, partially sectioned vertically.
Figure 5B:
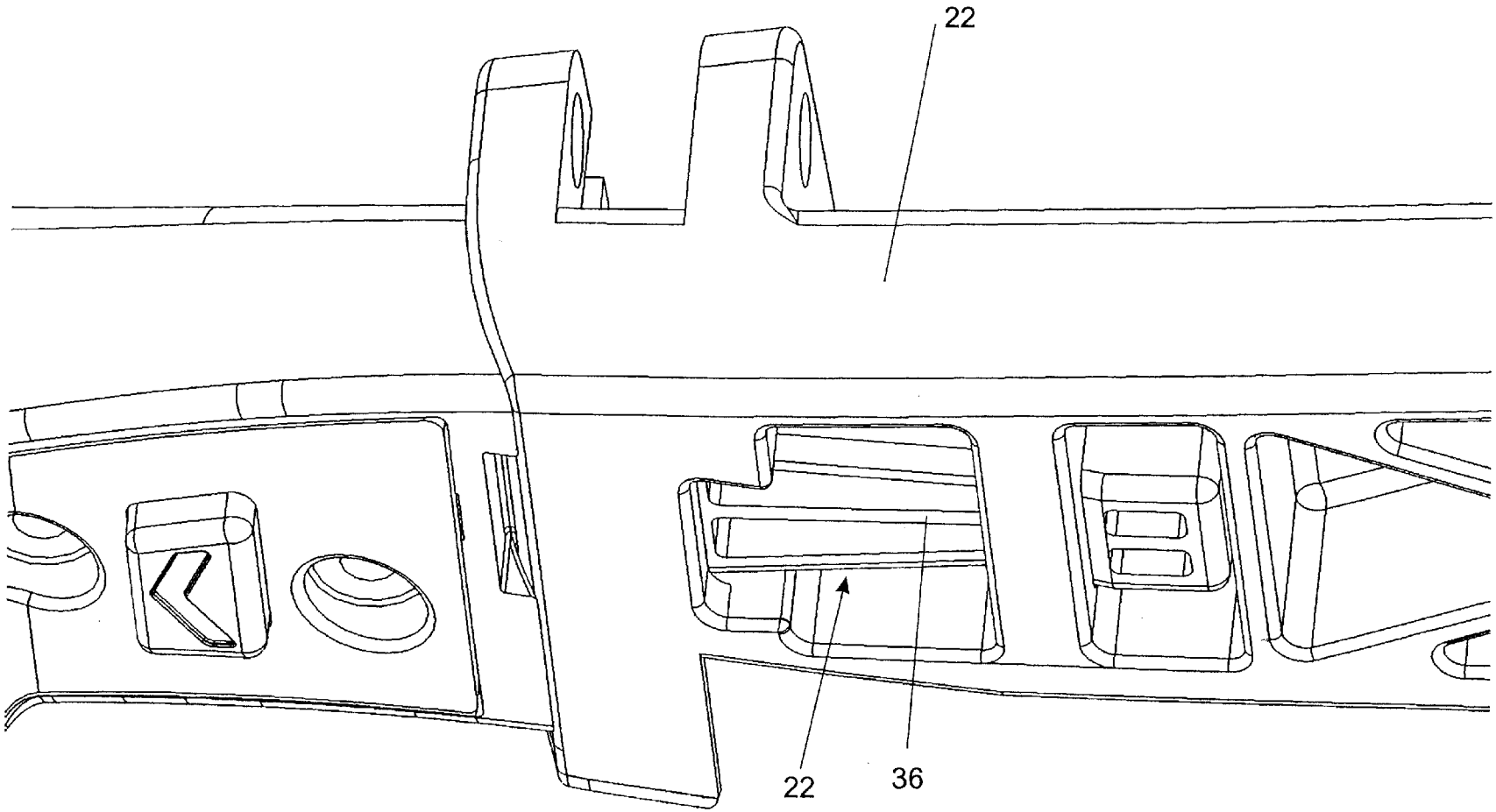
FIG. 5*b* is a perspective view from below of the parts illustrated in FIG. 5*a;*

The elongate attachment portion 30 engages within one end of the main transom 22 in the manner illustrated in FIG. 2. The manner of attachment is illustrated in more detail in FIGS. 4 and 5*a*–5*c* which are various views of the end of the transom 22 with the elongate attachment portion 30 engaged therein. As best shown in FIG. 5*a*, elongate attachment portion 30 includes an outer male engagement surface 32 and an inner male engagement surface 34. The outer male engagement surface 32 is spaced from the inner male engagement surface 34 thereby defining an intermediate portion 36 of tapering configuration. As will be appreciated in connection with the drawings, outer and inner define the positioning of the engagement surfaces relative to the arm assembly.

Each end of the main transom 22 includes an arm attachment portion in the form of a void to accommodate the elongate attachment portion 30. The void is not a fully sided hole but rather is defined only by an inner female engagement surface 38 and an outer female engagement surface 40 at the lower side thereof. It will be appreciated that the elongate attachment portion 30 will be supported on the inner and outer engagement surfaces 38, 40 of the main transom 22. Other surfaces of the elongate attachment portion 30 and the transom 22 are in contact. These are disposed at a clearance of 0.2 mm. The additional surfaces prevent side-to-side movement and up and down movement. It will be appreciated that in this context inner and outer are used from the perspective of the main chair assembly 12. In order to assemble the arm assembly 24 with the main assembly 12, the elongate attachment portion 30 is inserted into the main transom until the outer male engagement surface 32 engages against the inner female engagement surface 38 and the inner male engagement surface 34 engages against the outer female engagement surface 40. The male engagement surfaces are formed on parts of the elongate attachment portion 30 which are non-tapering and of small length compared to the length of the elongate attachment portion 30.

It can be seen that the elongate attachment portion 30 is downwardly inclined relative to the upright support structure 28. In this way, any downward force applied by the chair occupant to the armrest 26 will be resolved in the elongate attachment portion in a direction tending to push the elongate attachment portion into the arm attachment portion. A force in the upright direction applied to the armrest will also be resolved in the elongate attachment portion in the same manner due to a cantilever effect.

Figure 5C:
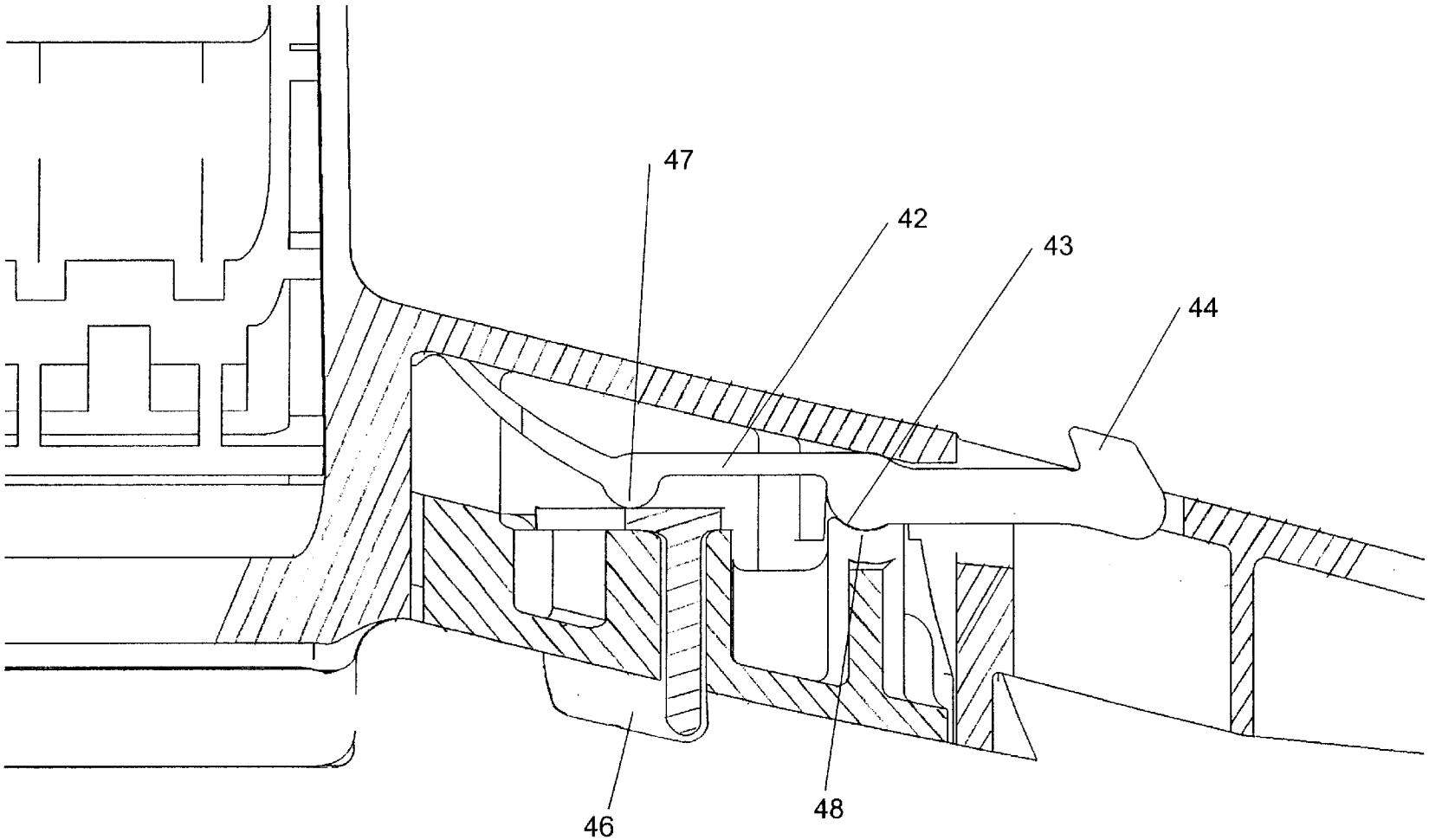
FIG. 5*c* is a vertical cross-section, like FIG. 5*a*, except illustrating a clip to secure attachment of the arm assembly.

Additionally, a clip is provided to secure the attachment of the arm assembly. As shown in FIG. 5*c*, the clip includes a latch member 42 having a hook portion 44 engageable against a latch surface 45 (see FIG. 5*a*) formed as part of the main transom 22. The latch member 42 has a first fulcrum 43 resting on pivot 48 and a second fulcrum 47 bearing against button 46. The latch member 42 is formed to include an integral spring with the second fulcrum 47 biasing the button 46 outwardly. As the button 46 is pushed inwardly, the latch member 42 pivots about fulcrum 43 to release the hook portion 44 from engagement with the latch surface 45 in order that the arm assembly 24 may be detached from the main chair assembly 12.

As best shown in FIG. 2, the support structure 28 includes an upper column member 50 telescopically received in a hollow lower column member 52. The upper column member 50 and the lower column member 52 are adjustable relative to one another to effect height adjustment in a manner which will be explained in more detail in connection with FIGS. 9 through 13. Extending at a downwardly inclined angle from a lower part of the lower member 52 is leg portion 54. The elongate attachment portion 30 is connected to the lower end of the leg portion 54. The upper column portion 50 supports a fixed portion 56 in normally fixed disposition thereto (given that the fixed portion 56 is height adjustable as will subsequently be explained).

Figure 6:
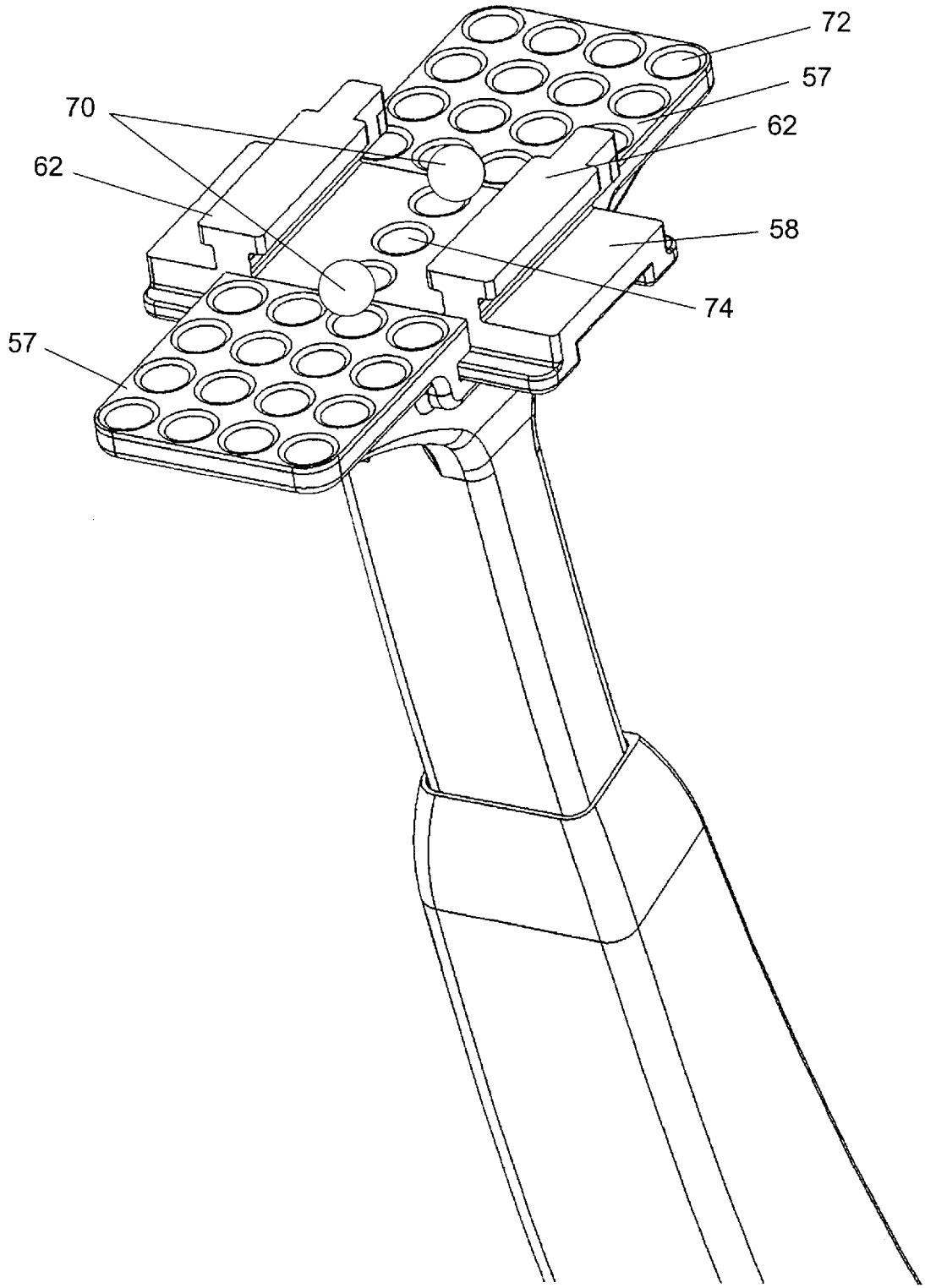
FIG. 6 is a perspective view of an upper portion of the arm assembly with parts removed for clarity.
Figure 8A:
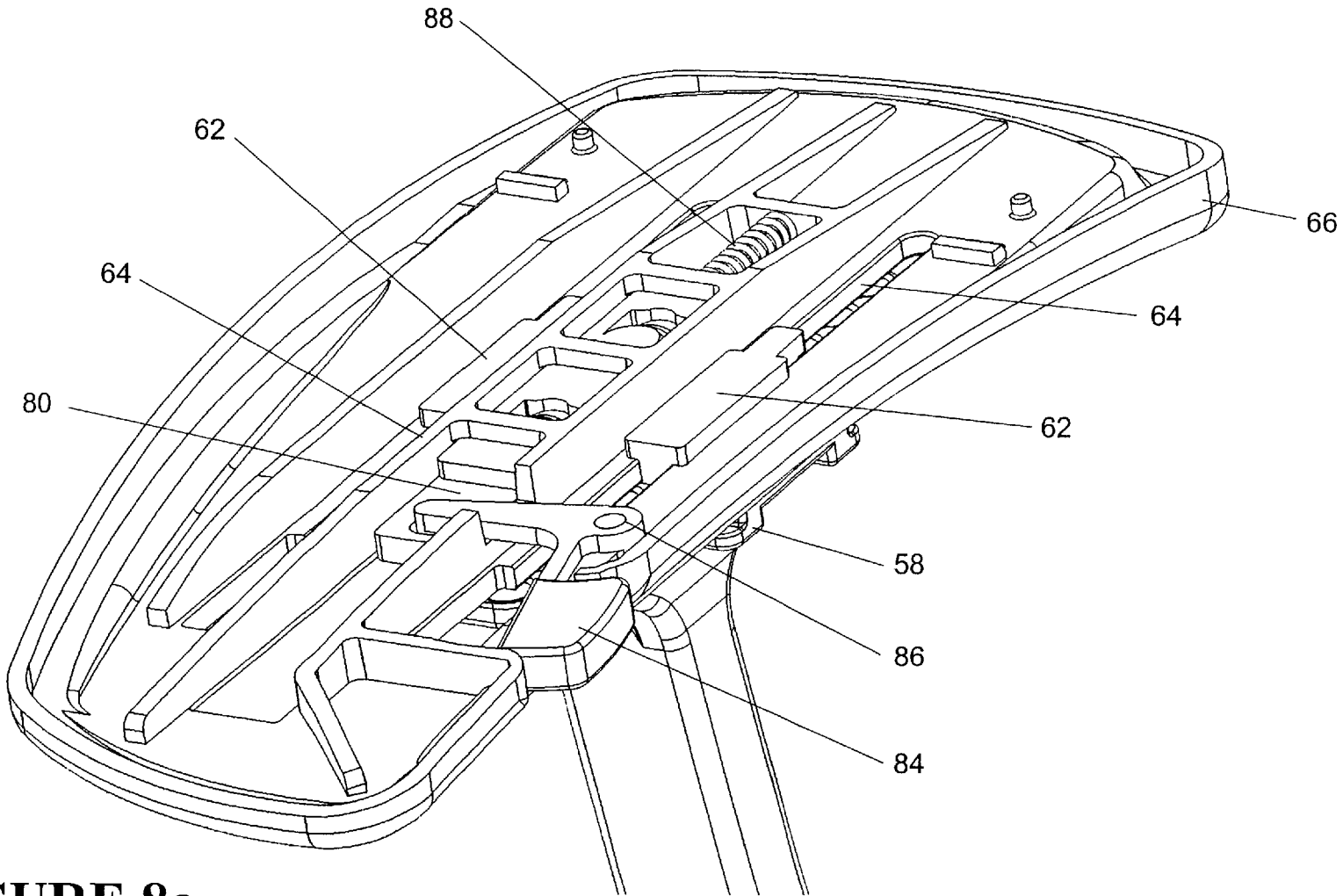
FIG. 8*a* is a detailed view of the upper part of the arm assembly with the armrest pad removed for clarity.
Figure 8B:
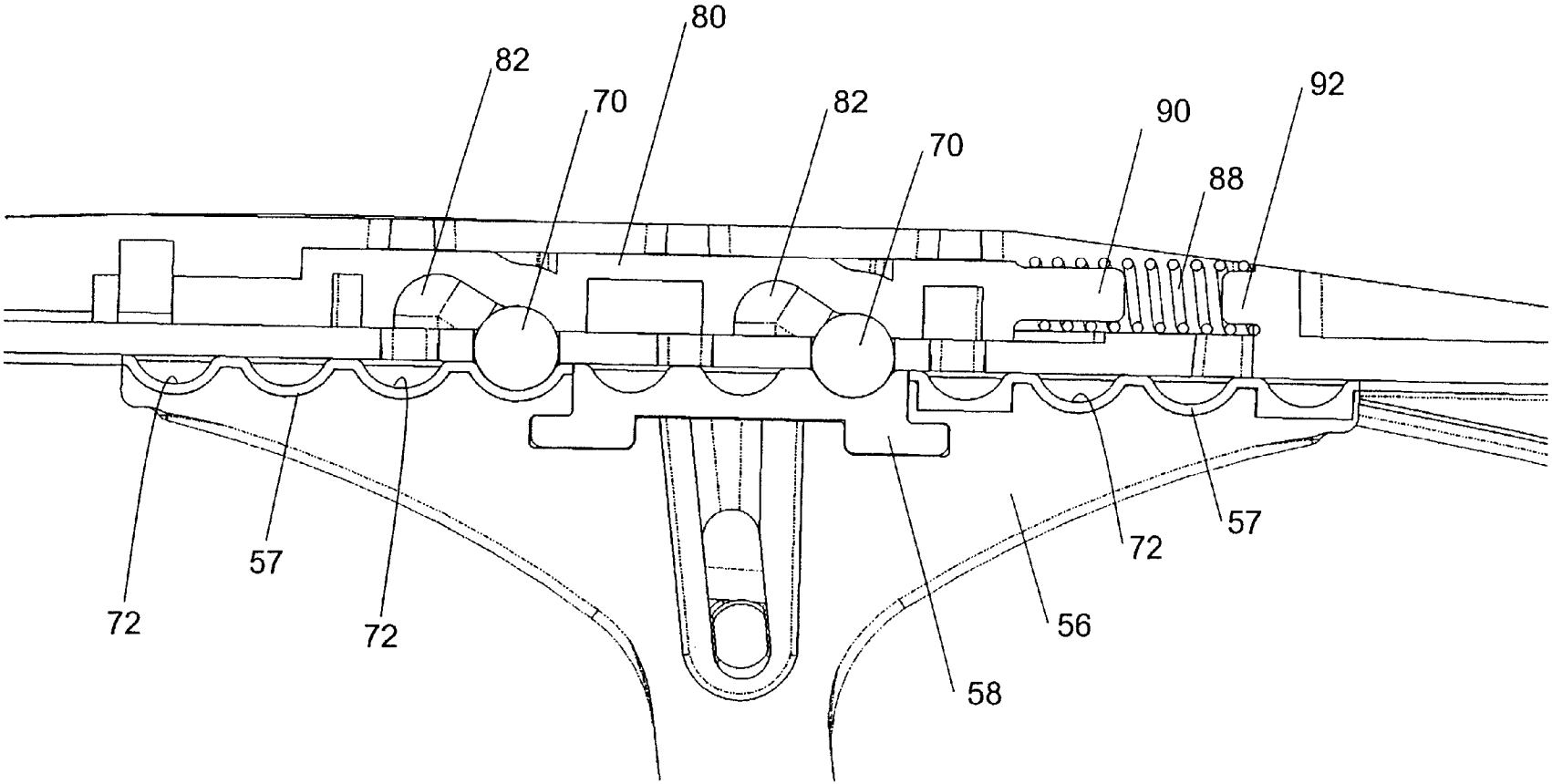
FIG. 8*b* is a longitudinal sectional view through the upper part of the armrest assembly illustrated in FIG. 8*a;*

Referring now to FIG. 6, the fixed portion can be seen to include two dimple pads 57 extending on either side of a transversely slidable carrier 58. The dimple pads 57 are two separate injection molded components self locating into the fixed portion 56. The dimples in the dimple pads provide a plurality of first engagement portions. As shown in FIG. 8*b*, the fixed portion 56 defines transverse guides for the slidable carrier 58. The carrier 58 is thereby slidable back and forth in the sideways direction of the chair. In FIG. *c*, it can be seen that the sides of the fixed portion 56 defines stops for side-ways movement of the carrier 58.

The carrier 58 additionally includes two longitudinal guides 62. The guides 62 are each of T-shaped configuration as shown. As best shown in FIG. 8*a*, the guides 62 extend through longitudinally extending slots 64 provided in a base portion 66 of the armrest, the ends of the slots defining stops for longitudinal movement. The base portion 66 of the armrest 26 is thereby slidable forward and backward along or parallel to a first longitudinal axis A (FIGS. 1 and 3) by the sliding action of the longitudinal guide 62 within the slots 64. Since the longitudinal guide 62 are formed or the carrier 58, as the carrier 58 slides sideways, the base portion 66 of the armrest 26 will be likewise carried in the sideways direction along or parallel to a second transverse axis B (FIGS. 1 and 3).

It will be understood that with the combined action of the longitudinal guide 62 and the transverse guide 60, the armrest will be able to move in any direction along the horizontal plane defined by the transverse guide and the longitudinal guide 62 within predetermined limits established by the stops. In order to establish a finite number of adoptable positions which the armrest 26 can adopt within the plane, the armrest carries a pair of discrete engagement members in the form of metal balls 70 in fixed disposition relative to each other to provide second engagement portion. Together, these balls can move across the carrier 58 and engage with respective ones of the dimples 72 provided on either of the dimple portions 57. Additionally, the carrier 58 also has dimples 74. These are arranged at a spacing whereby only one of the balls can engage with the carrier 58 at a time, with the other ball engaging with the dimple 72 from one or other of the dimple pads 56.

Figure 7:
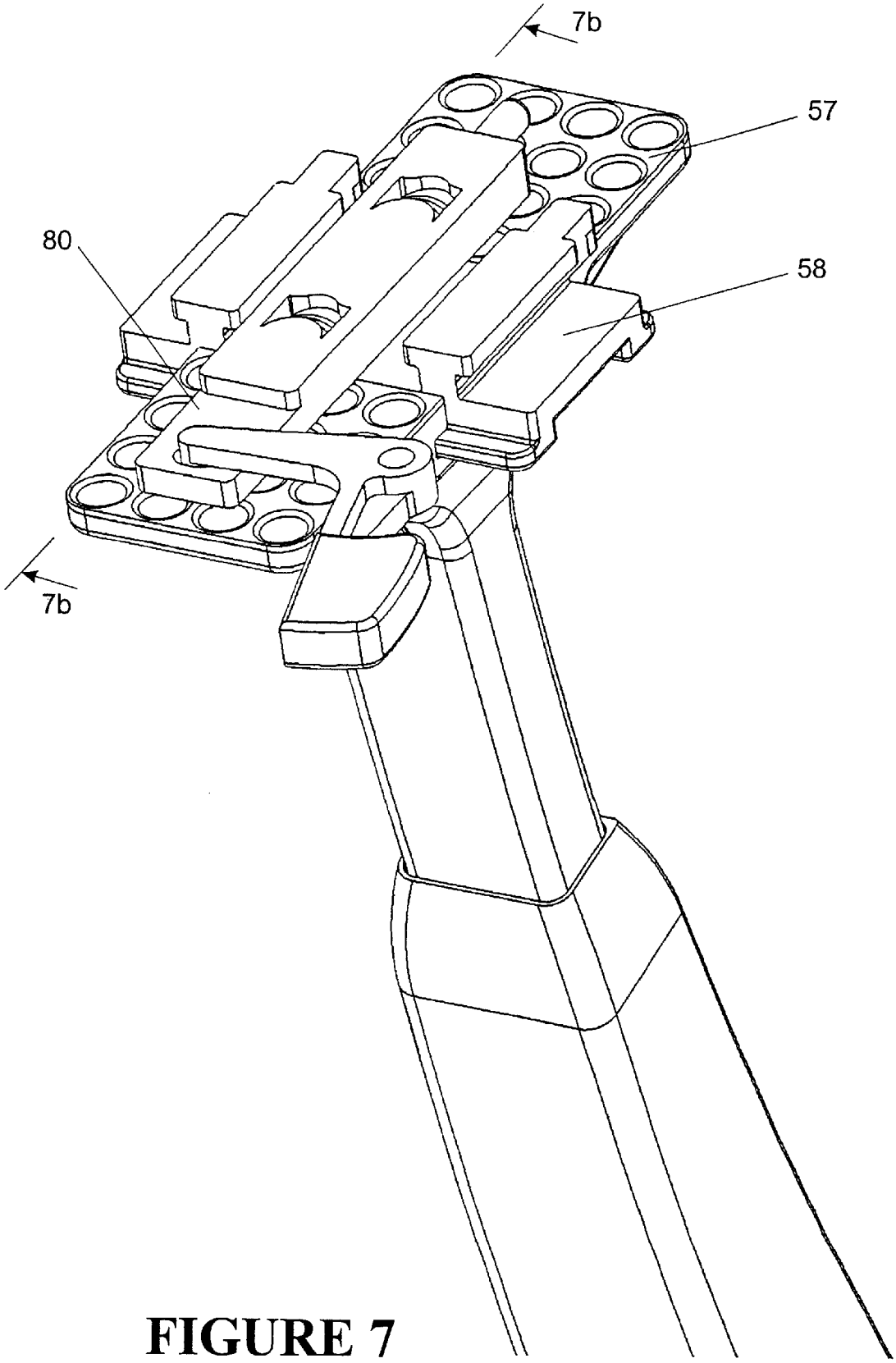
FIG. 7 is a perspective view as per FIG. 6 with additional parts shown.

The balls 70 are carried by the base portion 66 of the armrest 26 by way of slide 80 as shown in FIG. 7. On the underside of slide 80 as shown in FIG. 8*b*, two recesses 82 are provided, each for receiving one of the balls 70. Each recess is graduated to include a shallow part and deep part, the orientation of the shallow and deep parts being the same in each case. When the balls 70 are located in the shallow part of the recesses 82, the balls will be held into engagement with the engaged dimples. In order to release the balls 70 from engagement with the dimples 72 the slide 80 is slid in its lengthwise direction so that the deep part of the recess is engaged with the balls 70, thereby releasing the balls 70 from engagement with the dimples 72.

As shown in FIG. 8*a*, the slide 80 is slidably mounted within the base portion 66. A pivotable actuator 84 is pivoted to the base portion 66 about pivot 86. The pivotable actuator 84 is an L-shaped member with a depressor portion disposed conveniently on the armrest in the vicinity of the user's thumb. The slide 80 is biased by spring 88 towards an engagement position whereby the balls 70 reside in the shallow part of the recess in the slide. Therefore, the actuator 84 is operated against the bias of the spring 88. The end of the slide 80 opposite to the actuator 84 also incorporates an abutment projection 90 which in the release position of the slide member, engages against stop 92.

In operation, the user depresses actuator 84 with his or her thumb thereby moving the slide 80 to the release position whereby the balls 70 are released from engagement with the dimples 72. With the user holding his thumb against actuator 84, the base portion 66 can be slid forwards and backwards along the longitudinal guides 62. Additionally, the base portion 66 can be moved from side to side by movement of the carrier 58 along the transverse guides. Additionally, synchronous movement of the base portion 66 on the guide 62 and the carrier 58 on the transverse guides is possible so that the base portion 66 can move in any direction along the plane within predetermined outer limits. When the user releases the actuator 84, the balls 70 will bear against the dimple pads 57 and/or against the central portion of carrier 58. A slight adjustment of the armrest 26 will then locate the balls 70 within the closest dimples. The armrest will then be locked into the adopted position until the user again depresses the actuator 84.

Figure 9:
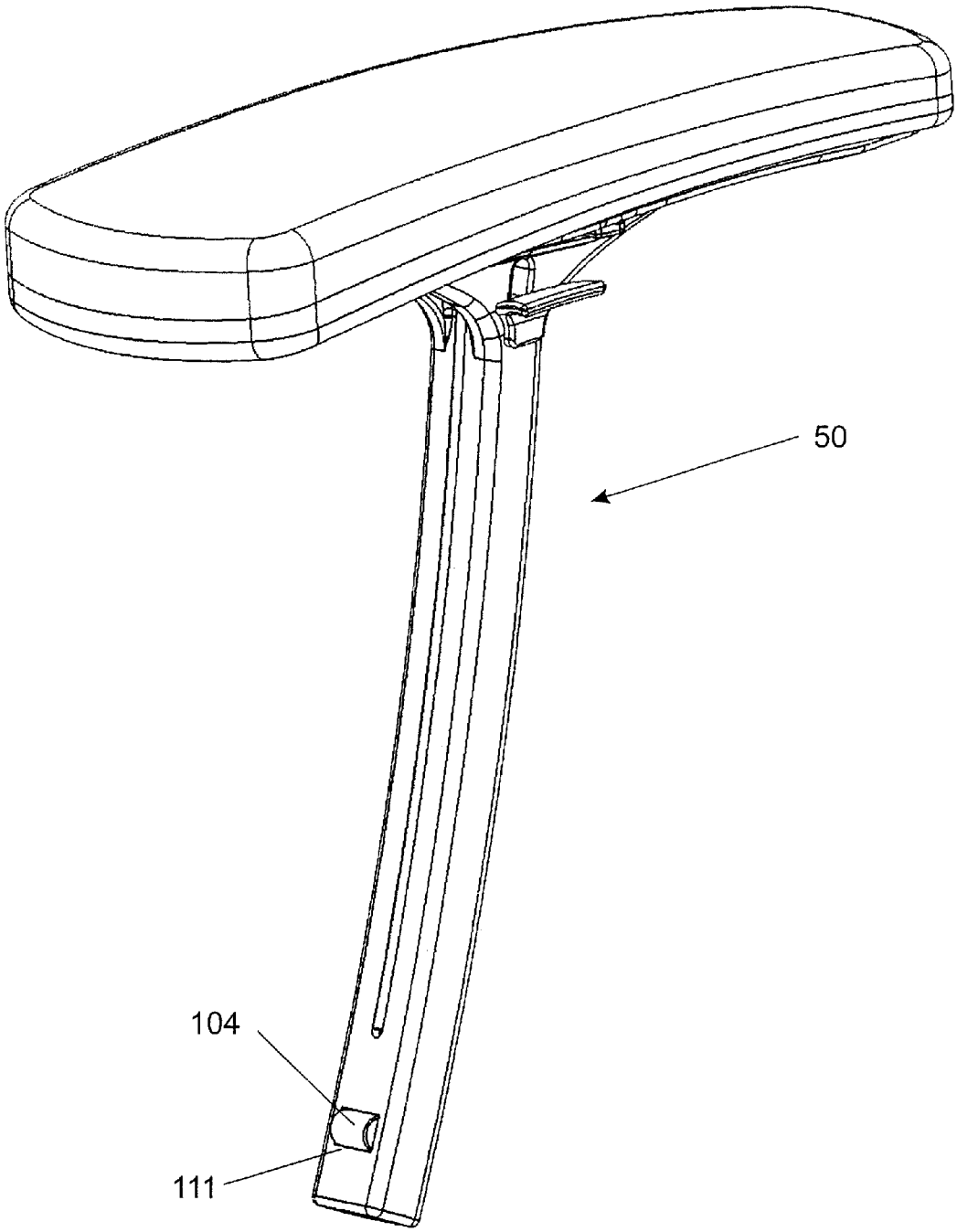
FIG. 9 is a perspective view of the armrest with a dependent upper column portion.
Figure 10:
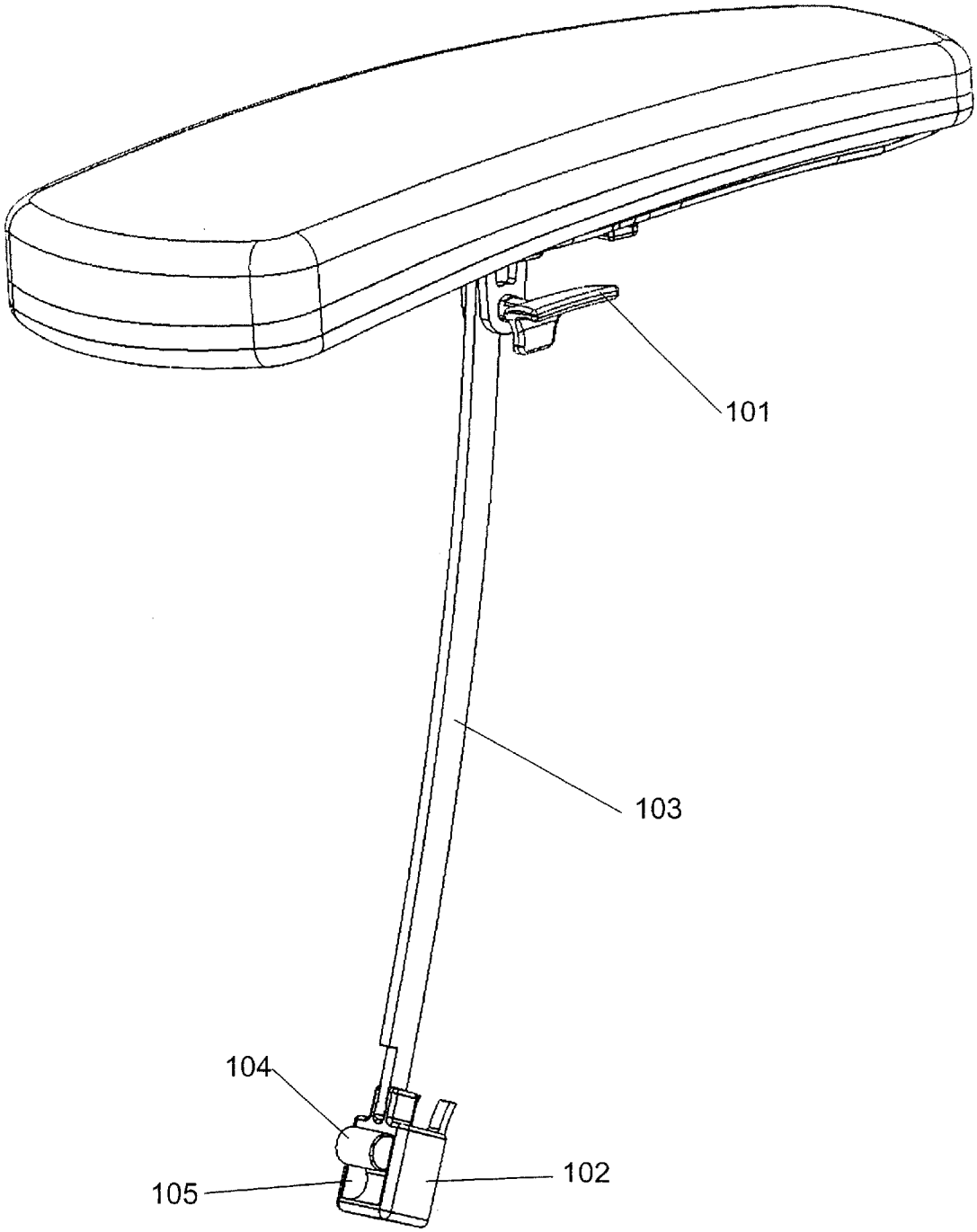
FIG. 10 is a perspective view of the armrest showing the internal detail of the upper column portion.

FIG. 9 illustrates the upper half of the armrest 26 with the upper column portion 50 removed from the lower column portion 52 within which it is normally telescopically received. The upper column portion 50 is a substantially solid column member. FIG. 10 illustrates the internal components of the upper column portion 50 including a height adjustment actuator 101, a roller carriage 102 and connecting rod 103. As can be seen in FIG. 10 and more clearly in FIG. 13, the roller carriage 102 has a graduated recess 105 provided therein having a deep part and a shallow part. A roller 104 is received within the graduated recess 105.

Figure 11:
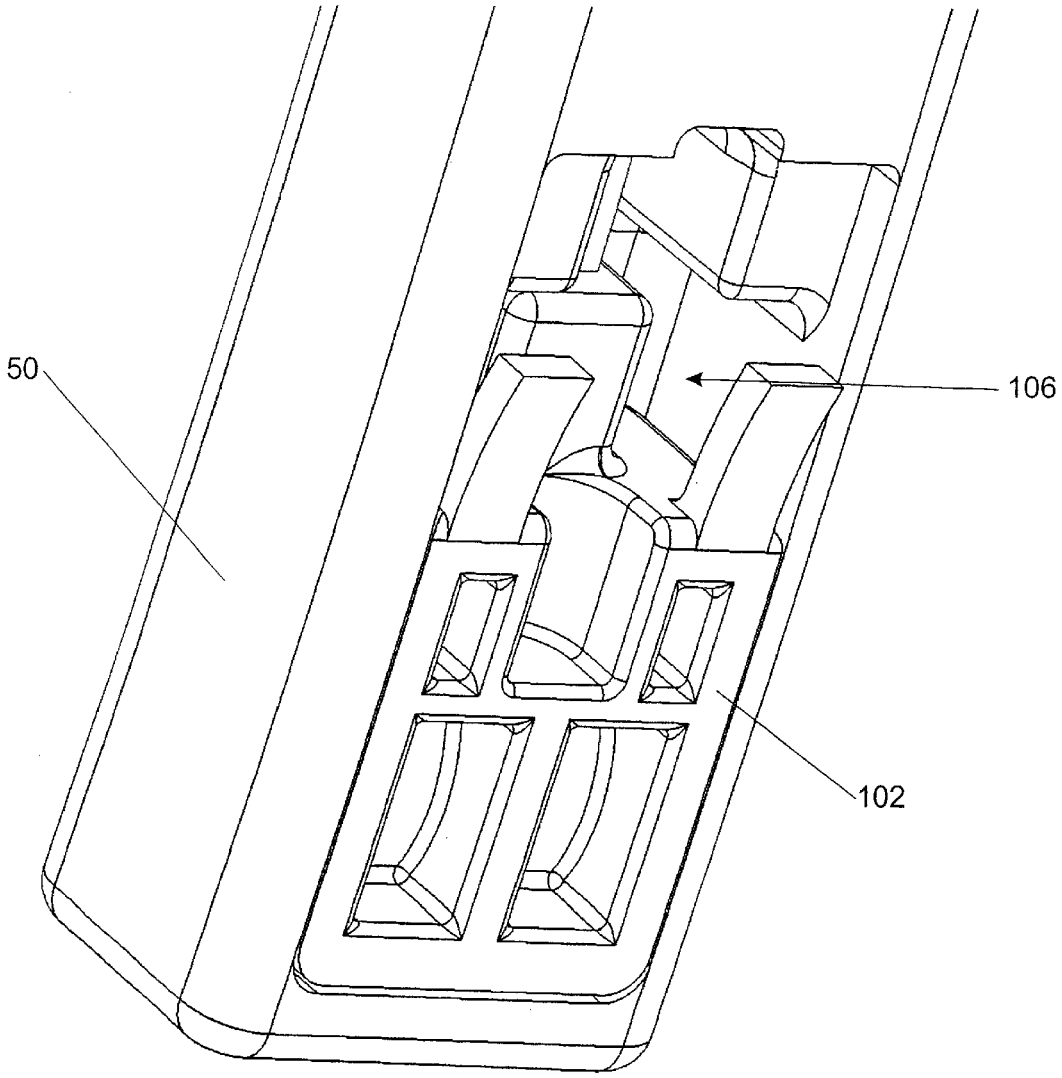
FIG. 11 is a detailed view of a lower part of the upper column portion 50 shown in FIG. 9, from the rear.

Referring to FIG. 11, the roller carriage 102 is slidable within the lower end of the upper column portion 50 as defined by a locating receptacle 106 in which the roller carriage 102 is housed. The roller carriage 102 is moveable within the receptacle 106 as the actuator 101 is operated by the user. The roller carriage is normally biased by a spring (not shown) into the lower most position illustrated in FIG. 11.

Figure 12:
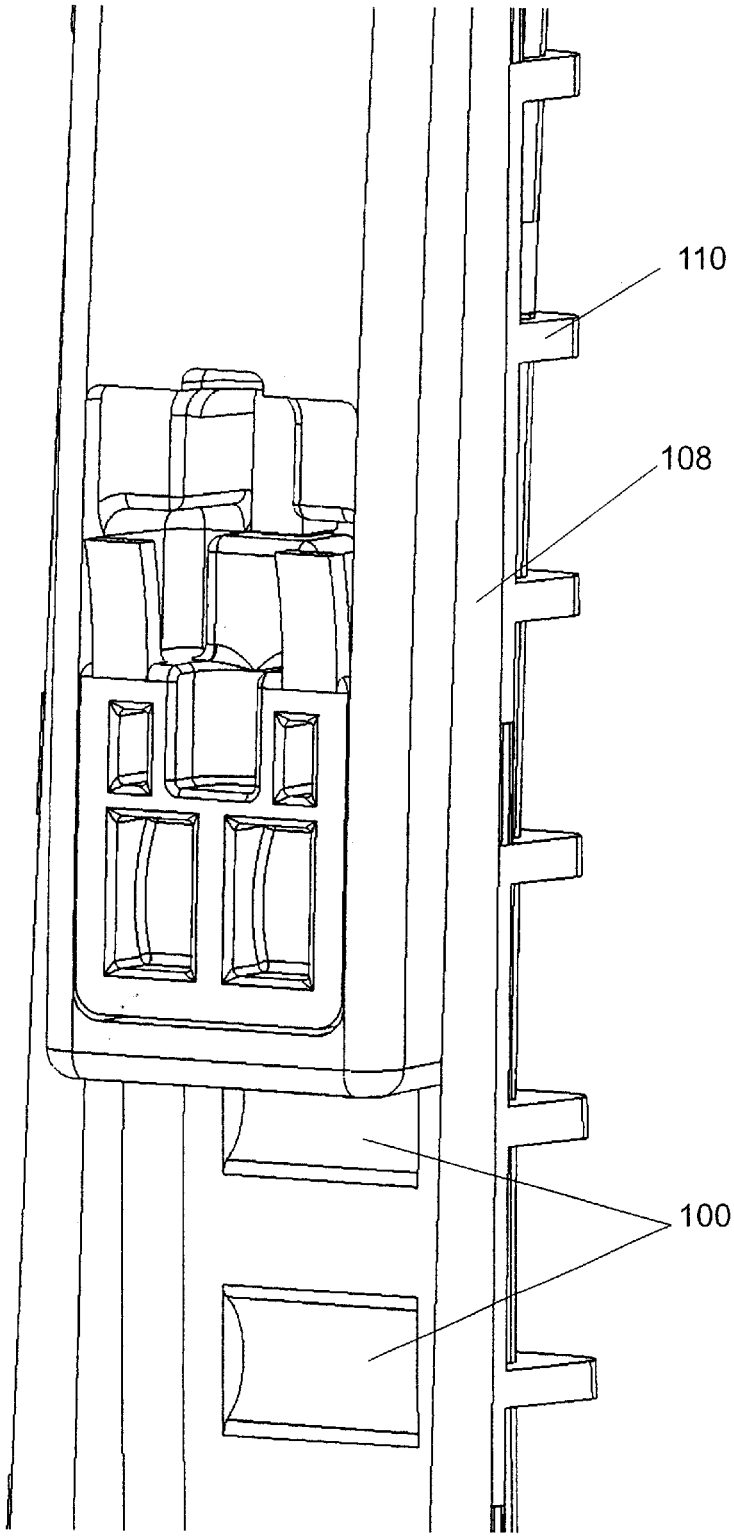
FIG. 12 illustrates the detail of the lower part of the upper column portion as shown in FIG. 11, received within a half portion of a stem liner.
Figure 13:
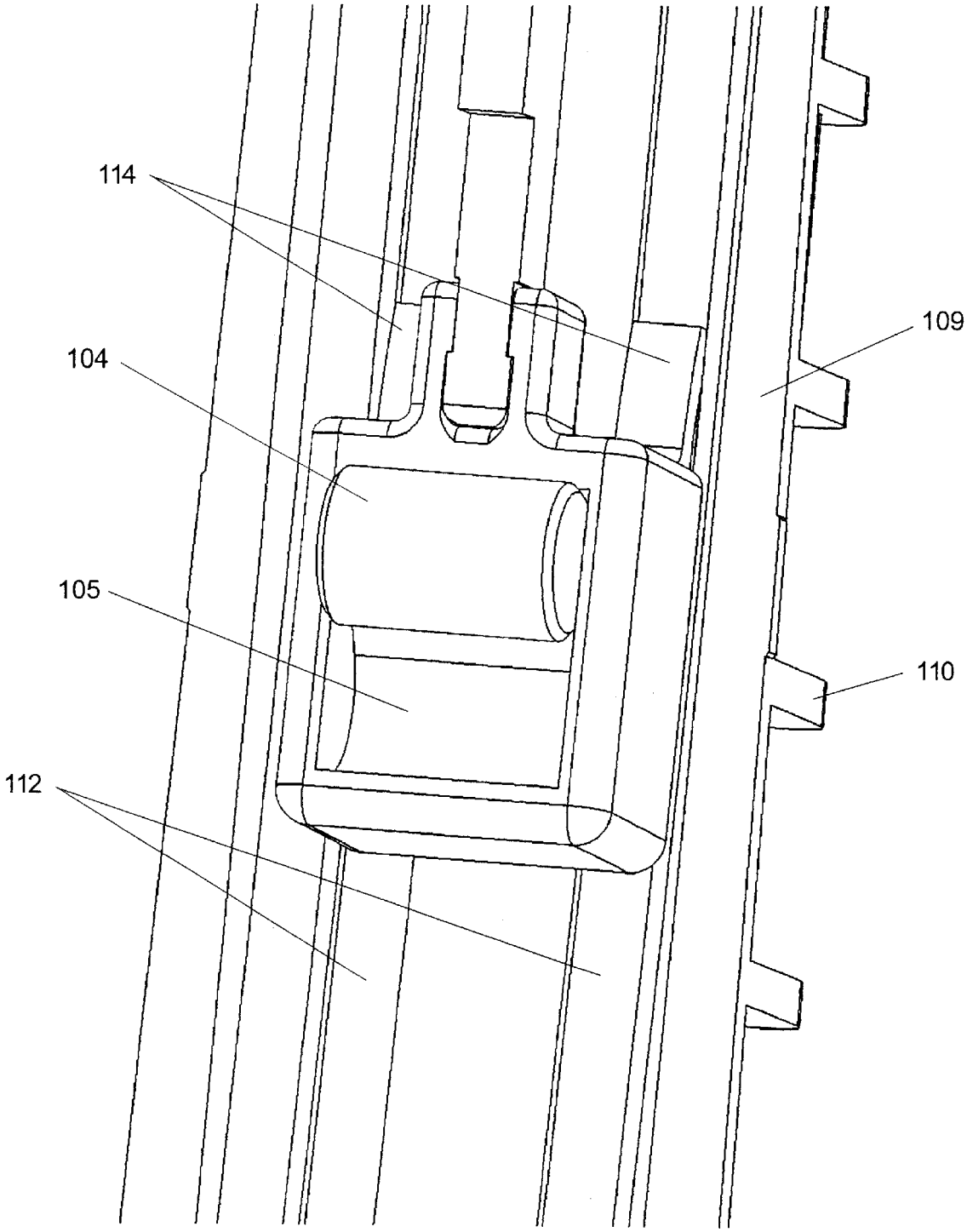
FIG. 13 is a detailed view of the other half portion of the stem liner.

As shown in FIGS. 12 and 13, the lower end of the upper column portion 50 is received within two half portions of a stem liner. One of the half portions 108 is illustrated in FIG. 12. The other half portion 109 is illustrated in FIG. 13. The two half portions 108, 109 together define a central conduit within which the lower part of the upper column portion 50 is telescopically received. The half portions of the stem liner 108, 109 fill part of the void within the hollow lower column portion 52. The ribs 110 assist with filling the void and also adds strength to the half portions of the stem liners. Additionally, one half portion of the stem liner has integrally formed leaf springs (not shown) to bias the stem liner towards one side of the lower column portion 52. Furthermore, one or both of the half portions of the stem liner have internal integrally formed leaf springs to reduce any slack between the upper column portion 50 and the stem liner.

The half portion 108 illustrated in FIG. 12 is provided with a series of spaced trough-like recesses 100. The roller 104 which in part protrudes through an opening 111 (See FIG. 9) is shaped to engage with any one of the trough shaped recesses 100. As already explained, the roller carriage 102 is normally biased by a spring into a lowermost position illustrated in FIG. 12. In this position, the roller 104 will be received in the shallow part of the graduated recess 105 while it is in engagement with one of the trough-like recesses 100.

When it is desired to adjust the height of the armrest 26, the user operates the actuator 101 in order to move the roller carriage 102 upwardly. The roller 104 in effect is moved down the graduated recess 105 towards the deep part until it is no longer held between the base of the recess 105 and the trough shaped recess 100. Once engagement between the roller 104 and the trough shaped recesses 100 is released, the upper column portion 50 can be moved relative to the lower column portion 52. Once the height of the armrest has been satisfactorily adjusted, the user releases the actuator. With possibly some slight adjustment required, the roller 104 will locate within the closest trough shaped recess 100 and in doing so, the roller carriage 102 will move with the bias of a spring (not shown) into a locking configuration with the roller 104 located in the shallow part of the recess and in engagement with a recess 100.

FIG. 13 illustrates the other half portion 109 of the stem liner, the inner side having two spaced tracks in the form of elongate recesses 112. The roller carriage 102 has two spaced guides 114 which are configured to be slidingly received within the tracks 112. At the upper end of the half portion 109, the tracks terminate and accordingly, this termination point will define an upper limit beyond which the guides 114 cannot be upwardly moved. This prevents the upper column portion 50 being fully withdrawn from the lower column portion 52.

Figure 14:
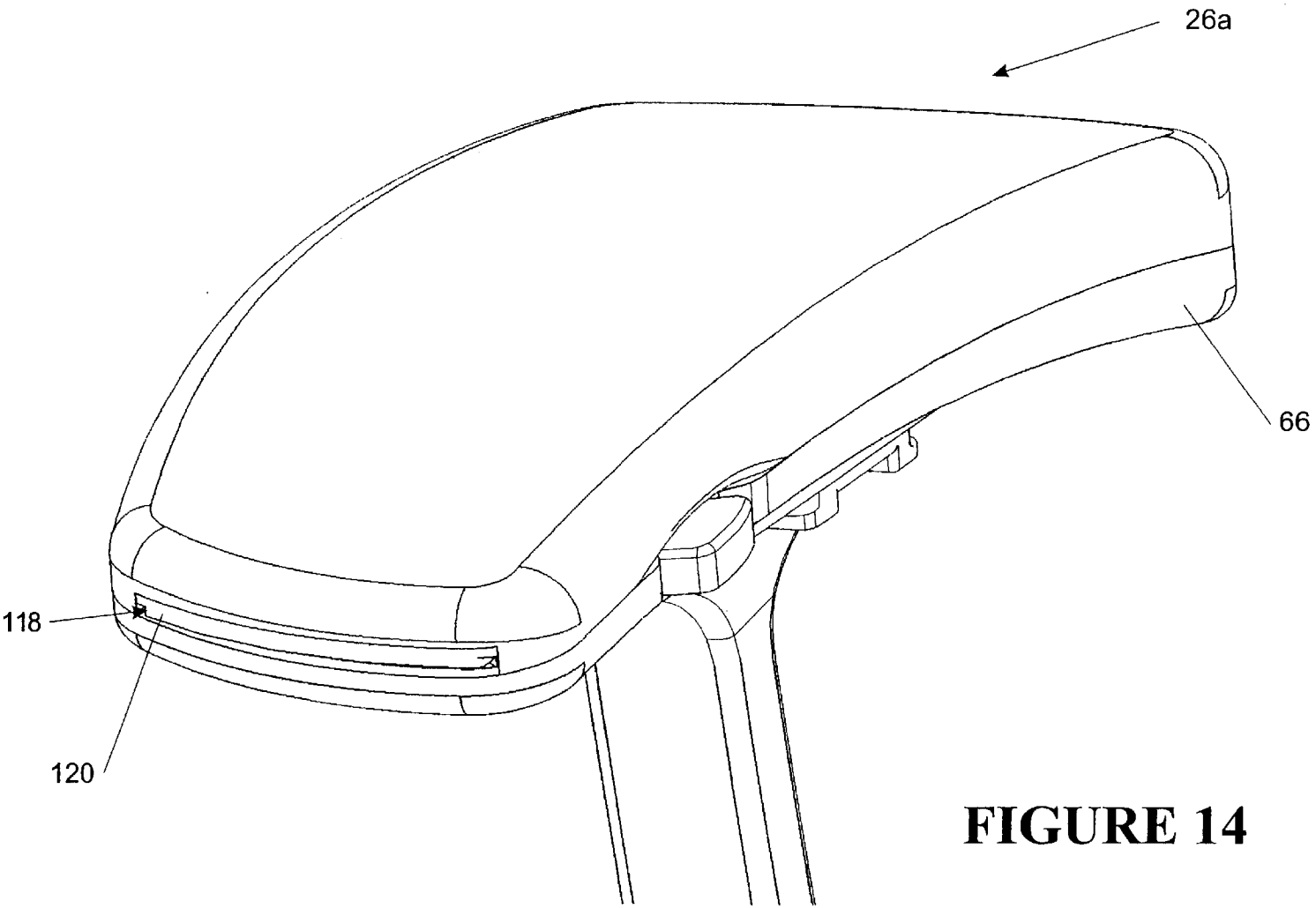
FIG. 14 is a perspective view of a modified form of an armrest in accordance with the present invention.
Figure 15:
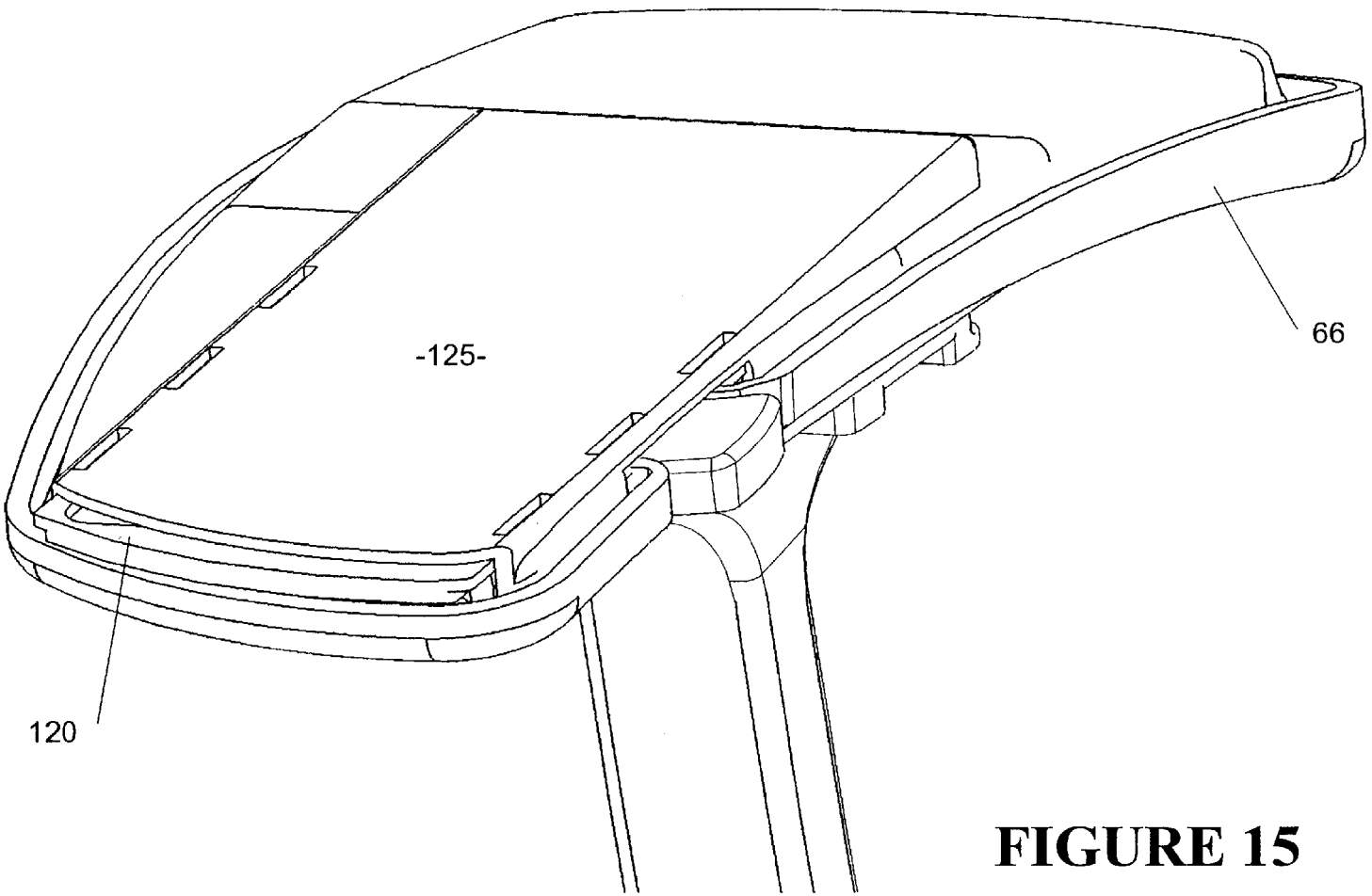
FIG. 15 is a view as per FIG. 14 with the armrest pad removed.
Figure 16:
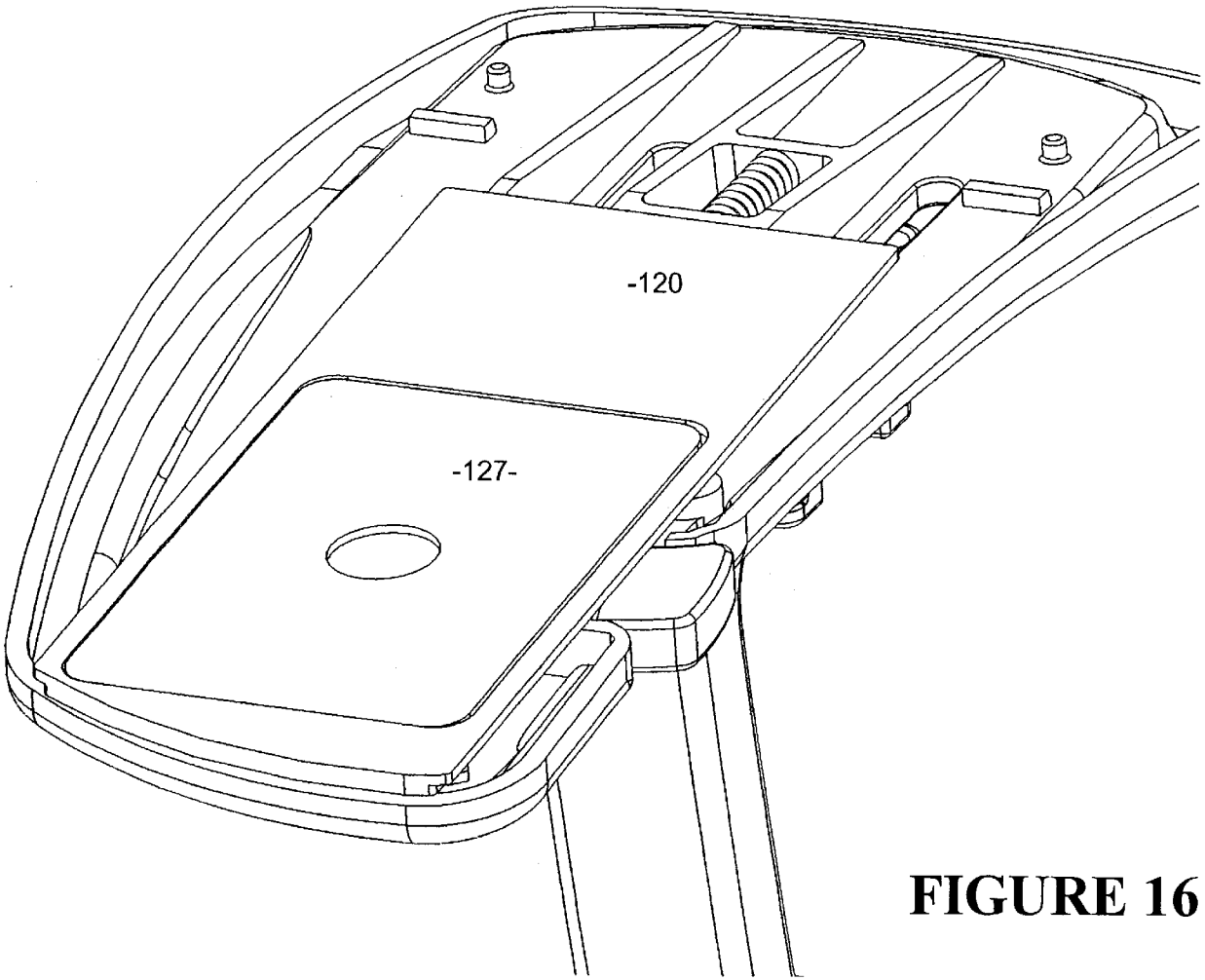
FIG. 16 is a view as per FIG. 15 with a further part removed.

FIG. 14 illustrates a modified form of the armrest 26*a*. The upper portion of the armrest 26*a* which is padded for user comfort includes an opening 118 in which a slide 120 is received. FIG. 15 is a view as per FIG. 14 except with the padded part of the upper portion removed. The slide 120 is slidably received within a slide casing 125, mounted on the base portion 66. The slide 120 can clearly be seen in FIG. 16. The slide includes a shallow rebate 127. An optical disk such as a CD (not shown) is received in the rebate 127. The CD is used with a computer to graphically illustrate the operating features of the chair 10.

Figure 17:
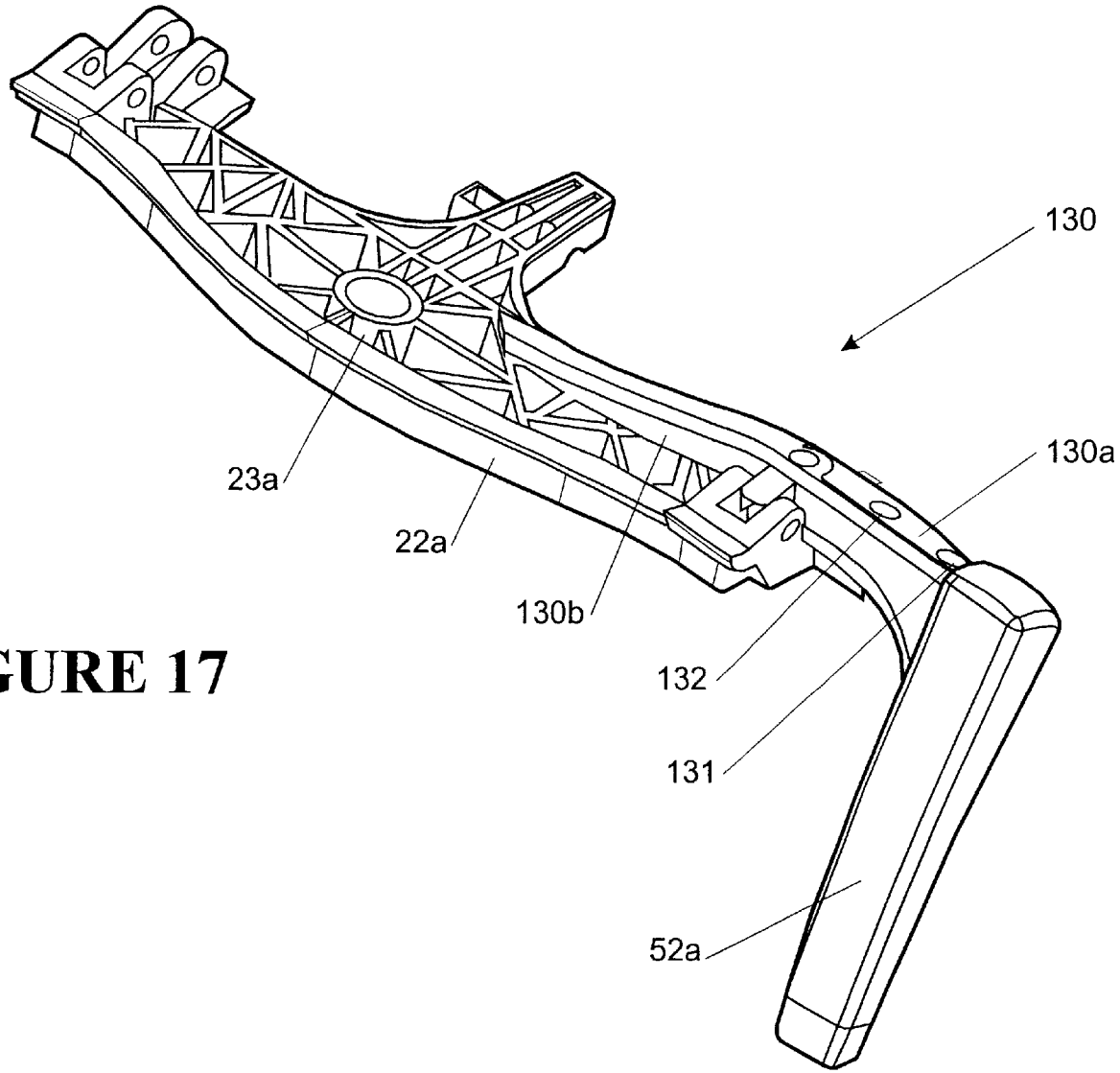
FIG. 17 is an underside perspective view of a modified transom together with a lower part of a modified form of the arm assembly mounted to the transom.
Figure 18:
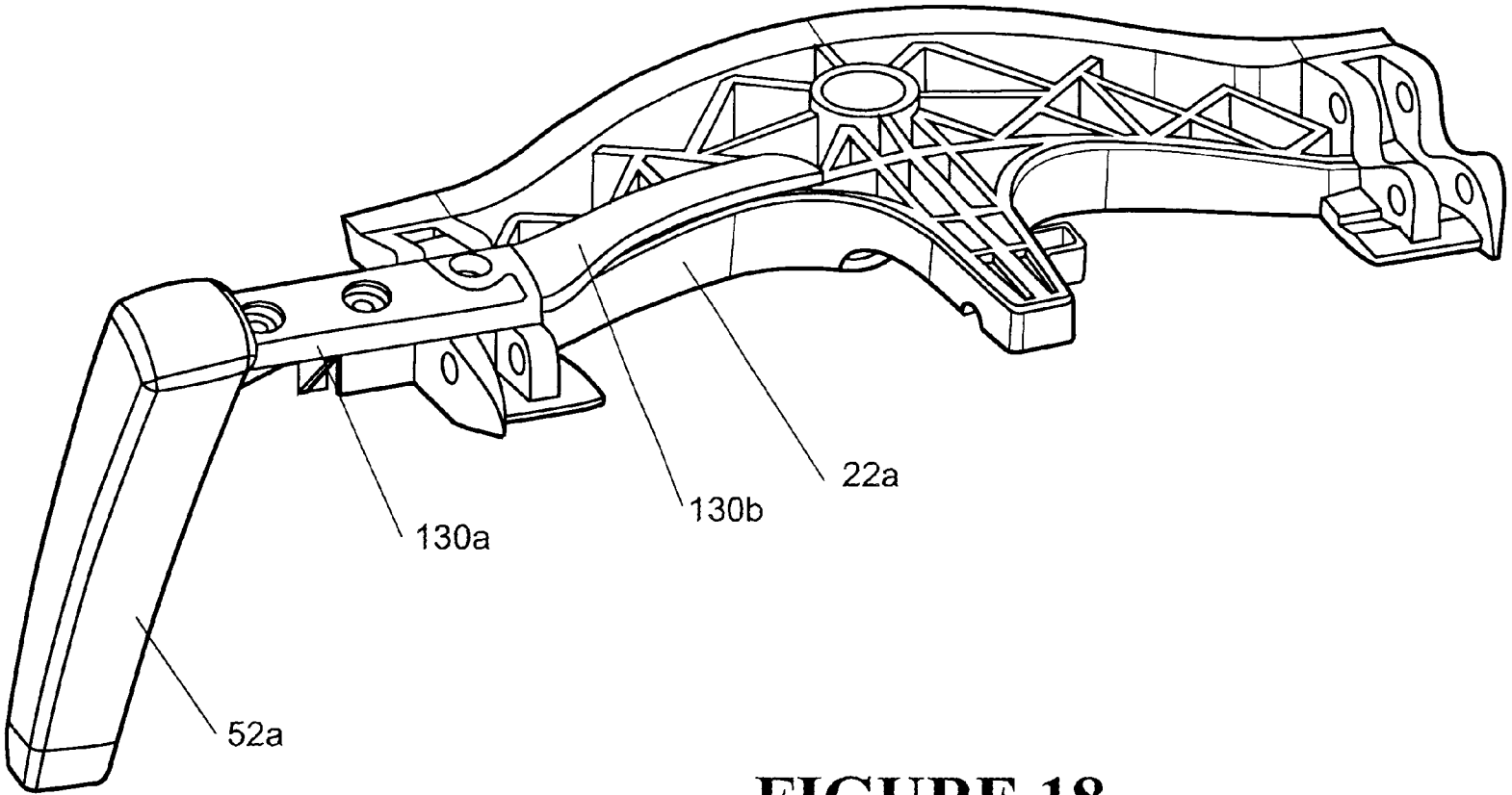
FIG. 18 is another underside perspective view as per FIG. 17.

FIGS. 17 and 18 illustrate of modified form of the main transom 22*a*. Several of the features of the main transom 22*a* are not described in detail here but are described in Provisional Application Serial No. 60/236,925 in connection with the description of the features and operation of the chair as a whole. The main transom 22*a* is supported from the base 18 by a pneumatic spring at central spring connection ring 23*a*.

Only the lower part of the modified form of the arm assembly is shown in FIGS. 17 and 18. This includes a lower column member 52*a* and an attachment portion 130 extending inwardly therefrom. The upper part of the modified form of the arm assembly may be the same as shown in the preceding drawings with the lower column member 52*a* telescopingly receiving the upper column member 50.

The attachment portion 130 is made up of two parts including an outer attachment section 130*a* which is integrally formed with the lower column portion 52*a*. Further, the attachment portion 130 includes an inner attachment section 130*b* which is bolted to the outer attachment section 130*a* by means of bolts 131 and 132. A further bolt 133 fastens the whole attachment portion 130 to the main transom 22*a*. The inner attachment section is provided mainly for aesthetic reasons.

The foregoing describes only one embodiment of the present invention and modifications can be made thereto without departing from the scope of the invention.

What is claimed is:

1. An arm assembly for a chair wherein the chair has a forward direction and a rearward direction, the arm assembly comprising:

an armrest;

a support structure; and a mounting device movably mounting the armrest to the support structure, the mounting device constraining the movement of the armrest relative to the support structure to movement in a substantially horizontal plane having two degrees of freedom defined by first and second transversely arranged axes lying within the substantially horizontal plane to move in a substantially planar fashion, the armrest being moveable independent along the first and second axes the movement being constrained so that the armrest cannot rotate in the horizontal plane.

2. The arm assembly as claimed in claim 1 wherein the arm assembly is adapted to be assembled with the chair with the first axis corresponding substantially to the forward direction of the chair and the second axis correspondings with the transverse direction of the chair.

3. The arm assembly as claimed in claim 1 further including first and second guides to guide the movement of the armrest.

4. The arm assembly as claimed in claim 3 wherein the mounting device incorporates a carrier and the first guided is incorporated into the carrier to guide movement of the armrest relative thereto with a corresponding first guided portion on the armrest and wherein the second guide is provided in fixed relationship to the support structure with a corresponding second guided portion incorporated into the carrier.

5. The arm assembly as claimed in claim 4 wherein the first guide is in the form of spaced parallel tracks and the first guided portions are in the form of slots or channels provided on the armrest.

6. The arm assembly as claimed in claim 5 wherein the second guide is in the form of a pair of parallel spaced opposed edges in fixed relationship to the support structure with the carrier being shaped for sliding engagement with the opposed edges.

7. The arm assembly as claimed in claim 1 wherein stops are provided to define a limit of movement along the first axis and along the second axis and the range of movement along the first axis is greater than the range of movement along the second axis.

8. The arm assembly as claimed in claim 1 wherein the armrest is selectively positionable in any one of a plurality of adoptable positions in the plane.

9. The arm assembly as claimed in claim 8 wherein the mounting device is such that there are a finite number of adoptable positions.

10. The arm assembly as claimed in claim 8 further including a locking device to releasably lock the armrest in any one of the adoptable positions.

11. The arm assembly as claimed in claim 10 wherein the locking device includes a fixed portion mounted in fixed disposition relative to at least the upper part of the support structure and the fixed portion including a plurality of first engagement portions, there being a second engagement portion carried by the armrest for selective releasable engagement with at least some of the first engagement portions, or the armrest having a plurality of first engagement portions with a second engagement portion fixed relative to the support structure for selective releasable engagement with at least some of the first engagement portions, the arrangement of said some of the first engagement portions being such that each defines an adoptable position of the armrest when the second engagement portion is engaged therewith.

12. The arm assembly as claimed in claim 11 wherein the second engagement portion is in the form of a discrete engagement member and wherein the first engagement portions are correspondingly shaped recesses or slots or holes to engagingly receive the engagement member.

13. The arm assembly as claimed in claim 12 wherein the discrete engagement member is normally biased into a position for engagement with one of the first engagement portions.

14. The arm assembly as claimed in claim 12 wherein the second engagement member is in the form of a ball.

15. The arm assembly as claimed in claim 11 wherein the fixed portion is in the form of a pad having an engagement surface with a spaced array of dimples formed on the engagement surface.

16. The arm assembly as claimed in claim 11 further comprising first and second guides to guide the movement along the longitudinal and transverse axes respectively, the mounting device further including a carrier wherein the first guide is provided on the carrier with a corresponding first guided portion on the armrest to guide movement of the armrest relative to the carrier wherein the second guide is incorporated into the fixed portion with a corresponding second guided portion incorporated into the carrier, wherein the fixed portion extends forward and rearward of the carrier and the plurality of first engagement portions are provided on the fixed portion.

17. The arm assembly as claimed in claim 16 wherein further first engagement portions are provided on the carrier.

18. The arm assembly as claimed in claim 17 wherein there are two second engagement portions with the arrangement of corresponding first engagement portions on the carrier being such that both second engagement portions are not engageable with the carrier at the same time.

19. The arm assembly as claimed in claim 10 wherein the locking device is operable to normally lock the armrest in each of the adoptable positions, the locking device being selectively releasable.

20. The arm assembly as claimed in claim 11 wherein the locking device further includes a separator to selectively separate the second engagement portion from engagement with the first engagement portion.

21. The arm assembly as claimed in claim 20 wherein the separator is in the form of a moveable slide having an engagement position whereby the first and second engagement portions are in engagement and a release position allowing disengagement of the first and second engagement portions.

22. The arm assembly as claimed in claim 21 wherein the second engagement portion comprises one or more discrete engagement members, the moveable slide including one or more shaped recesses of graduated or varying depth with a shallow part and a deep part, with the engagement position of the slide corresponding to the discrete engagement members being received in the shallow part and the release position of the slide corresponding to the discrete engagement members being received in the deep part of respective recesses.

23. The arm assembly as claimed in claim 19 wherein the locking device incorporates an actuator which is disposed for operation by the hand of a user whose corresponding arm is supported by the armrest.

24. An arm assembly for a chair having a forwards direction and a transverse direction, said arm assembly comprising:

a longitudinal axis such that the arm assembly is adapted to be assembled with the chair with the longitudinal axis of the arm assembly corresponding substantially to the forward direction of the chair, a transverse axis arranged such that with the arm assembly assembled with the chair, the transverse axis corresponds to the transverse direction of the chair;

an armrest;

a support structure attachable to the chair, the armrest being mounted to the support structure by way of a mounting device such that the armrest is selectively moveable relative to the support structure forwards and backwards to adopt any one of a plurality of coordinate locations along the longitudinal axis and side to side to adopt any one of a plurality of coordinate locations along the transverse axis the side to side movement being independent of movement along the longitudinal axis, whereby the armrest is selectively positionable in any one of a plurality of discrete adoptable positions defined by its respective coordinate locations along the longitudinal and transverse axes, the mounting device incorporating a locking device to releasably lock the armrest in any one of the discrete adoptable positions.

25. The arm assembly as claimed in claim 24 wherein the armrest is movable in a grid pattern.

26. The arm assembly as claimed in claim 24 further including first and second guides to guide the movement along the longitudinal and transverse axes respectively.

27. The arm assembly as claimed in claim 26 wherein the mounting device incorporates a carrier and the first guide is incorporated into the carrier to guide movement of the armrest relative thereto with a corresponding first guided portion on the armrest and wherein the second guide is provided in fixed relationship to the support structure with a corresponding second guided portion incorporated into the carrier.

28. The arm assembly as claimed in claim 27 wherein the first guide is in the form of spaced parallel tracks and the first guided portions are in the form of slots or channels provided on the armrest.

29. The arm assembly as claimed in claim 28 wherein the second guide is in the form of a pair of parallel spaced opposed edges in fixed relationship to the support structure with the carrier being shaped for sliding engagement with the opposed edges.

30. The arm assembly as claimed in claim 24 wherein stops are provided to define a limit of movement along the longitudinal axis and along the transverse axis and the range of movement along the longitudinal axis is greater than the range of movement along the transverse axis.

31. The arm assembly as claimed in claim 24 wherein the mounting device is such that there are finite number of adoptable positions.

32. The arm assembly as claimed in claim 24 wherein the locking device includes a fixed portion mounted in fixed disposition relative to at least the upper part of the support structure and the fixed portion including a plurality of first engagement portions, there being a second engagement portion carried by the armrest for selective releasable engagement with at least some of the first engagement portions, or the armrest having a plurality of first engagement portions with a second engagement portion fixed relative to the support structure for selective releasable engagement with at least some of the first engagement portions, the arrangement of said some of the first engagement portions being such that each defines an adoptable position of the armrest when the second engagement portion is engaged therewith.

33. The arm assembly as claimed in claim 32 wherein the second engagement portion is in the form of a discrete engagement member and wherein the first engagement portions are correspondingly shaped recesses or slots or holes to engagingly receive the engagement member.

34. The arm assembly as claimed in claim 33 wherein the discrete engagement member is normally biased into a position for engagement with one of the first engagement portions.

35. The arm assembly as claimed in claim 34 wherein the second engagement member is in the form of a ball.

36. The arm assembly as claimed in claim 32 wherein the fixed portion is in the form of a pad having an engagement surface with a spaced array of dimples formed on the engagement surface.

37. The arm assembly as claimed in claim 32 further including first and second guides to guide the movement along the longitudinal and transverse axes respectively, the mounting device further including a carrier wherein the first guide is provided on the carrier with a corresponding first guided portion on the armrest to guide movement of the armrest relative to the carrier wherein the second guide is incorporated into the fixed portion with a corresponding second guided portion incorporated into the carrier, wherein the fixed portion extends forward and rearward of the carrier and the plurality of first engagement portions are provided on the fixed portion.

38. The arm assembly as claimed in claim 37 wherein further first engagement portions are provided on the carrier.

39. The arm assembly as claimed in claim 38 wherein there are two second engagement portions with the arrangement of corresponding first engagement portions on the carrier being such that both second engagement portions are not engageable with the carrier at the same time.

40. The arm assembly as claimed in claim 24 wherein the locking device is operable to normally lock the armrest in each of the adoptable positions, the locking device being selectively releasable.

41. The arm assembly as claimed in claim 32 wherein the locking device further includes a separator to selectively separate the second engagement portion from engagement with the first engagement portion.

42. The arm assembly as claimed in claim 41 wherein the separator is in the form of a moveable slide having an engagement position whereby the first and second engagement portions are in engagement and a release position allowing disengagement of the first and second engagement portion.

43. The arm assembly as claimed in claim 42 wherein the second engagement portion comprises one or more discrete engagement members, the moveable slide including one or more shaped recesses of graduated or varying depth with a shallow part and a deep part, with the engagement position of the slide corresponding to the discrete engagement members being received in the shallow part and the release position of the slide corresponding to the discrete engagement members being received in the deep part of respective recesses.

44. The arm assembly as claimed in claim 24 wherein the locking device incorporates an actuator which is disposed for operation by the hand of a user whose corresponding arm is supported by the armrest.

45. An arm assembly for a chair having a forwards direction and a transverse direction, said arm assembly comprising:

a longitudinal axis such that the arm assembly is adapted to be assembled with the chair with the longitudinal axis of the arm assembly corresponding substantially to the forward direction of the chair;

a transverse axis arranged such that with the arm assembly assembled with the chair, the transverse axis corresponds to the transverse direction of the chair;

an armrest;

a support structure attachable to the chair, the armrest being selectively moveable relative to the chair forwards and backwards to adopt any one of a plurality of coordinate locations along the longitudinal axis and side to side to adopt any one of a plurality of coordinate locations along the transverse axis the side to side movement being independent of movement along the longitudinal axis, whereby the armrest is selectively positionable in any one of a plurality of discrete adoptable positions defined by its respective coordinate locations along the longitudinal and transverse axes; and a locking device to releasably lock the armrest in any one of the discrete adoptable positions wherein the locking device is operable by a user's hand positioned on the armrest.

46. The arm assembly as claimed in claim 45 wherein the armrest is movable in a grid pattern.

47. The arm assembly as claimed in claim 45 further including first and second guides to guide the movement along the longitudinal and transverse axes respectively.

48. The arm assembly as claimed in claim 45 wherein stops are provided to define a limit of movement along the longitudinal axis and along the transverse axis and the range of movement along the longitudinal axis is greater than the range of movement along the transverse axis.

49. The arm assembly as claimed in claim 45 wherein there are finite number of adoptable positions for the armrest.

50. The arm assembly as claimed in claim 45 wherein the locking device is operable to normally lock the armrest in each of the adoptable positions, the locking device being selectively releasable.

* * * * *

UNITED STATES PATENT AND TRADEMARK OFFICE

CERTIFICATE OF CORRECTION

PATENT NO. : 6,802,566 B2 
DATED : October 12, 2004
INVENTOR(S) : Jonathan William Prince and Paul Micheal Wilkinson It is certified that error appears in the above-identified patent and that said Letters Patent is hereby corrected as shown below:

Title page,
Item [56], References Cited, U.S. PATENT DOCUMENTS, remove
"5,560,438 A 10/1996 Collee et al.
5,560,439 A 10/1996 Delwiche et al."
insert -- 5,660,438 A 8/1997 Tedesco
5,660,439 A 8/1997 Unwalla --
FOREIGN PATENT DOCUMENTS, insert -- DE 295 19 794 U1 5/1997
DE 299 01 666 U1 4/2000 --

Figure 8C:
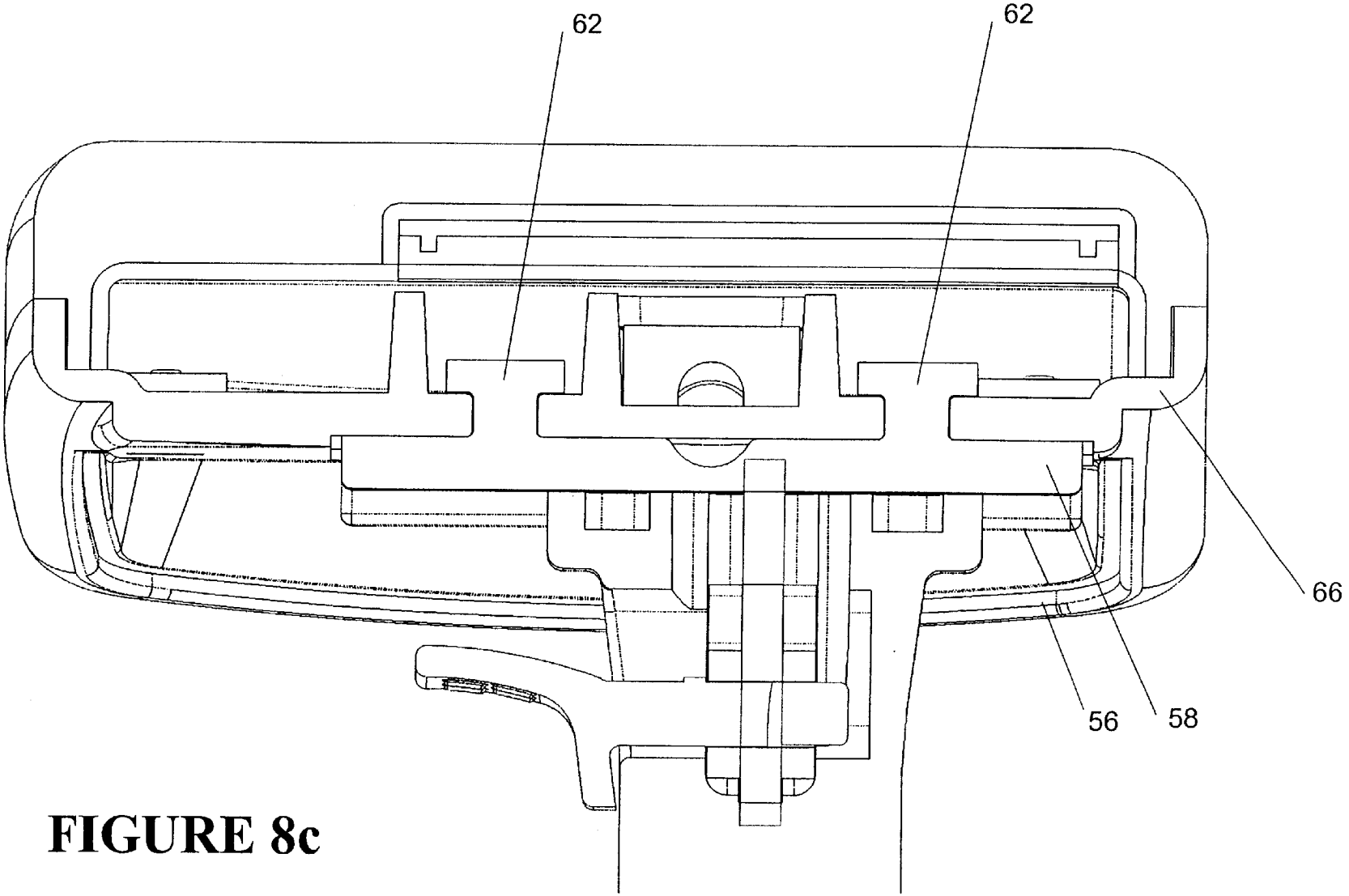
FIG. 8*c* is a transverse sectional view through the upper part of the armrest assembly illustrated in FIG. 8*a;*
Figure 8D:
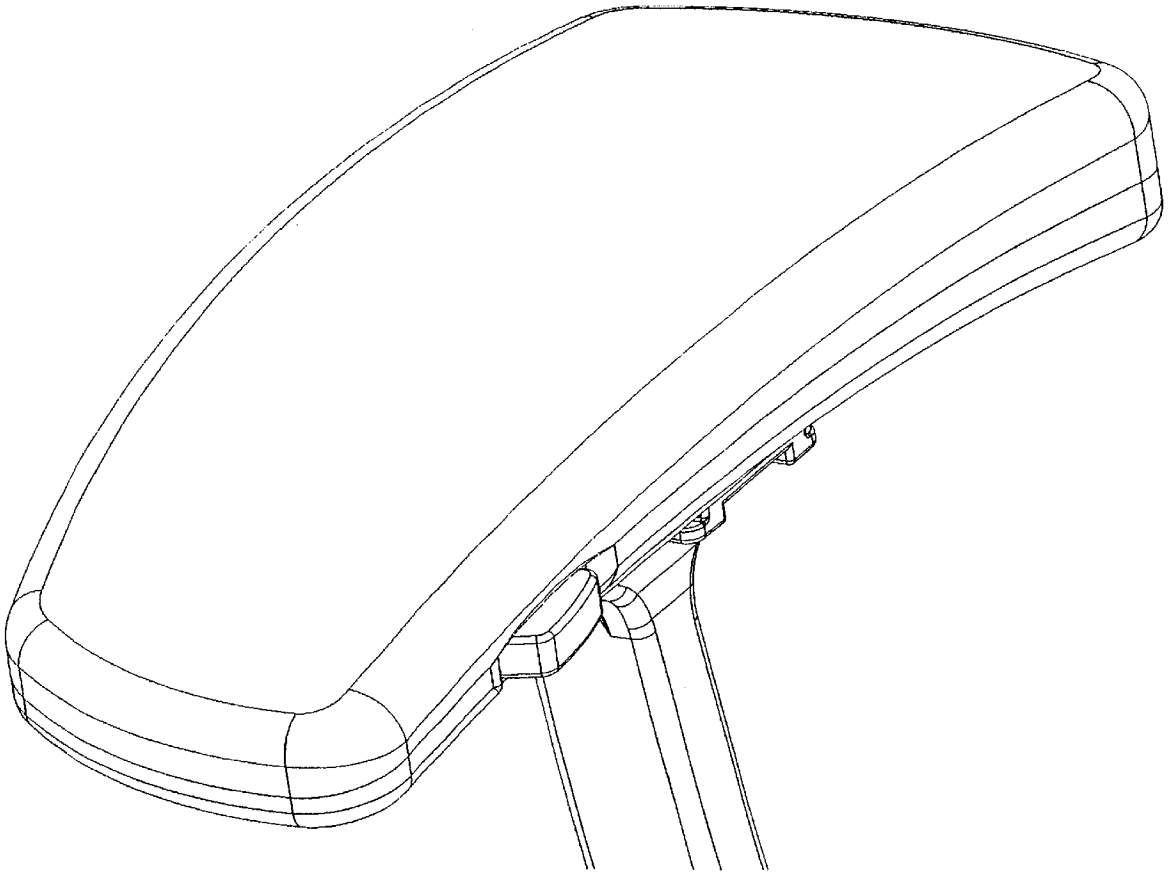
FIG. 8*d* is a perspective view of an armrest pad of the armrest illustrated in FIG. 1.

Column 10,
Line 21, change "FIG. c," to -- FIG. 8c, --
Line 22, change "defines" to -- define --
Line 33, after "formed" change "or" to -- on --
Line 54, before "other" insert -- the --

Column 11,
Line 58, change "adds" to -- add --

Column 13,
Line 27, change "correspondings" to -- corresponding --
Line 33, change "guided" to -- guide --

Column 15,
Line 23, after "axis" insert -- , --

UNITED STATES PATENT AND TRADEMARK OFFICE

CERTIFICATE OF CORRECTION

PATENT NO. : 6,802,566 B2
DATED : October 12, 2004
INVENTOR(S) : Jonathan William Prince and Paul Micheal Wilkinson It is certified that error appears in the above-identified patent and that said Letters Patent is hereby corrected as shown below:

Column 17,
Line 20, after "axis" insert -- , --

Signed and Sealed this

Twenty-eighth Day of June, 2005

JON W. DUDAS
*Director of the United States Patent and Trademark Office*